US012185823B2

(12) United States Patent
Ota

(10) Patent No.: US 12,185,823 B2
(45) Date of Patent: Jan. 7, 2025

(54) BACKPACK AND BACKPACK SET

(71) Applicant: Hiroaki Ota, Hirosaki (JP)

(72) Inventor: Hiroaki Ota, Hirosaki (JP)

( * ) Notice: Subject to any disclaimer, the term of this patent is extended or adjusted under 35 U.S.C. 154(b) by 64 days.

(21) Appl. No.: 17/581,922

(22) Filed: Jan. 22, 2022

(65) Prior Publication Data

US 2022/0142337 A1 May 12, 2022

Related U.S. Application Data

(63) Continuation of application No. PCT/JP2020/023119, filed on Jun. 11, 2020.

(30) Foreign Application Priority Data

Jul. 24, 2019 (JP) ..... 2019-135739

(51) Int. Cl.
*A45F 3/08* (2006.01)
*A45F 3/04* (2006.01)

(52) U.S. Cl.
CPC ..... *A45F 3/08* (2013.01); *A45F 3/047* (2013.01)

(58) Field of Classification Search
CPC ..... A45C 7/0045; A45C 7/005; A45C 7/0086; A45F 3/04; A45F 3/042; A45F 3/047; A45F 3/08; A45F 2003/166
USPC ..... 224/653, 681–683
See application file for complete search history.

(56) References Cited

U.S. PATENT DOCUMENTS 5,729,869 A * 3/1998 Anscher ..... A45C 7/0086 224/652
5,732,867 A 3/1998 Perkins et al.
5,954,250 A * 9/1999 Hall ..... A62B 25/00 224/629

FOREIGN PATENT DOCUMENTS

JP 1980-089318 U 6/1980
JP 1991-058120 U 6/1991
JP 2004-065624 A 3/2004
JP 2006-141883 A 6/2006
JP 2017-192473 A 10/2017
TR 201707398 A2 * 5/2017
(Continued)

OTHER PUBLICATIONS

TR 201707398 A2 Translation, Osman, May 2017 (Year: 2017).*
(Continued)

*Primary Examiner* — Nathan J Newhouse
*Assistant Examiner* — Matthew T Theis
(74) *Attorney, Agent, or Firm* — Polsinelli PC

(57) ABSTRACT

The backpack encompasses a box-shaped storage-compartment having first and second main surfaces opposite to each other and a triple-sided surface whereby triple continuous sides of the first main surface and triple sides of the second main surface opposite thereto are connected to each other, and a back plate encompassing a joint plane opposite to the first main surface and a backrest plane opposite to the joint plane. A convex element is disposed on one of the first main surface or the joint plane, and an insertion hole with a structure matching the convex element is disposed on a position on the other of the first main surface or the joint plane corresponding to the convex element. The storage-compartment and the back plate can be freely attached to and detached from each other by placing the convex element into
(Continued)

the insertion hole and separating the convex element from the insertion hole.

13 Claims, 17 Drawing Sheets

(56) References Cited

FOREIGN PATENT DOCUMENTS

| | | | | |
|---|---|---|---|---|
| WO | WO 2013/104338 A1 | 7/2013 | | |
| WO | WO-2014077421 A1 * | 5/2014 | ..... | A45C 7/0045 |

OTHER PUBLICATIONS

WO 2014077421 A1 Translation, Cho Y, May 22, 2014 (Year: 2014).*

International Search Report and Written Opinion, dated Jul. 21, 2020, for the corresponding International Application No. PCT/JP2020/023119 in 10 pages.

* cited by examiner

BACKPACK AND BACKPACK SET

REFERENCE

This application is a continuation of International Application PCT/JP2020/023119, with an international filing date of Jun. 11, 2020, which claims benefit of priority under 35 USC 119 based on Japanese Patent Application No. 2019-135739 filed Jul. 24, 2019, the entire contents of each application are incorporated by reference herein.

BACKGROUND OF THE INVENTION

Field of the Invention

The present invention relates to a backpack, a set of backpacks, each of which is capable of optional select in a plurality of combinations of storage-compartments and a back plate, and a set of backpacks, each of which is capable of optional select in a plurality of the combinations of storage-compartments and a plurality of back plates.

Description of the Related Art

A backpack, such as a school backpack (the school backpacks for elementary school students are called "randsels" in Japan), a rucksack, a day pack, an attack-sack, a small knapsack, and a Kissling rucksack, is made of nylon, real leather, synthetic leather, etc., and is a bag for easily taking goods out from inside. Furthermore, the backpack has no frame in many cases. And we can carry the backpack on our back by hanging the shoulder strap attached to a main body of the backpack on our shoulder.

As an example of the backpack described above, JP2017-192473A discloses a structure for easily putting goods in and out. The backpack recited in JP2017-192473A is separated into a part which can be carried on our back by a pair of left and right shoulder belts and a storage-compartment which can store goods. As a result, when taking goods out from the backpack, the taking out becomes easy by operating a rope with the pair of belts and by sliding the storage-compartment in a direction of right side or left side at a user's sufficient convenience using a lower portion of a main body of a support part as a fulcrum.

However, in the earlier backpack, a main body of the backpack which stores documents, etc., and a shoulder strap are unified. So, there is a problem that we have to replace with another backpack, when desiring to change a color, shape or size according to a use or preference.

SUMMARY OF THE INVENTION

A first aspect of the present invention inheres in a backpack encompassing (a) a box-shaped storage-compartment having first and second main surfaces having rectangular shapes, respectively, the first and second main surfaces being opposite to each other, and triple side-surfaces mutually connecting triple continuous sides of the first main surface with counterpart triple sides of the second main surface, and (b) a back plate configured to be removable from the storage-compartment, having a joint plane opposite to the first main surface when combining the back plate with the storage-compartment, a backrest plane opposite to the joint plane, and (c) a pair of shoulder straps bridging from an upper portion of the backrest plane to double sites located a lower portion of the backrest plane, (d) a convex element provided on either one of the first main surface or the joint plane, and (e) an insertion hole cut in other one of the first main surface or the joint plane, having a structure and a location corresponding to the convex element, (f) wherein the storage-compartment can be freely attached to the back plate by inserting the convex element in the insertion hole, and the storage-compartment can be freely detached from the back plate by extracting the convex element from the insertion hole.

A second aspect of the present invention inheres in a set of backpacks, each of backpacks encompassing a plurality of storage-compartments, and a back plate removable from the storage-compartments. (a) Each of the storage-compartments has a box-shaped structure, and has first and second main surfaces having rectangular shapes, respectively, the first and second main surfaces being opposite to each other, and triple side-surfaces mutually connecting triple continuous sides of the first main surface with counterpart triple sides of the second main surface. (b) The back plate has a plate-shaped structure, and has a joint plane opposite to the first main surface when combining the back plate with the storage-compartment and a backrest plane opposite to the joint plane. The set of backpacks (c) has a pair of shoulder straps bridging from an upper portion of the backrest plane to double sites located a lower portion of the backrest plane, (d) a set of convex elements provided on each of the first main surfaces of the plurality of storage-compartments or a convex element provided on the joint plane, and (e) an insertion hole cut in the joint plane, or a set of convex elements provided on each of the first main surfaces of the plurality of storage-compartments, having structures and locations corresponding to the convex elements, and (f) wherein a combination of one of storage-compartments and the back plate can be optionally selected, and a selected storage-compartment can be freely attached to the back plate by inserting the convex element in the insertion hole, and the selected storage-compartment can be freely detached from the back plate by extracting the convex element from the insertion hole.

A third aspect of the present invention inheres in a set of backpacks, each of the backpacks encompassing a plurality of storage-compartments, and a plurality of back plates removable from the storage-compartments, respectively. (a) Each of the storage-compartments has a box-shaped structure, and has first and second main surfaces having rectangular shapes, respectively, the first and second main surfaces being opposite to each other, and triple side-surfaces mutually connecting triple continuous sides of the first main surface with counterpart triple sides of the second main surface. (b) Each of the back plates has a plate-shaped structure, and has a joint plane opposite to the first main surface when combining the back plate with the storage-compartment and a backrest plane opposite to the joint plane. The set of backpacks (c) has a pair of shoulder straps bridging from an upper portion of the backrest plane to double sites located a lower portion of the backrest plane, (d) a set of convex elements provided on each of the first main surfaces of the plurality of storage-compartments or on each of the joint planes, and (e) a set of insertion holes cut in each of the joint planes, or in each of the first main surfaces of the plurality of storage-compartments, having structures and locations corresponding to the convex elements, and (f) wherein a combination of one of storage-compartments and one of the back plates can be optionally selected, and a selected storage-compartment can be freely attached to a selected back plate by inserting the convex element in the insertion hole, and the selected storage-compartment can be freely detached from the selected back plate by extracting the convex element from the insertion hole.

DETAILED DESCRIPTION OF THE INVENTION

Figure 1:
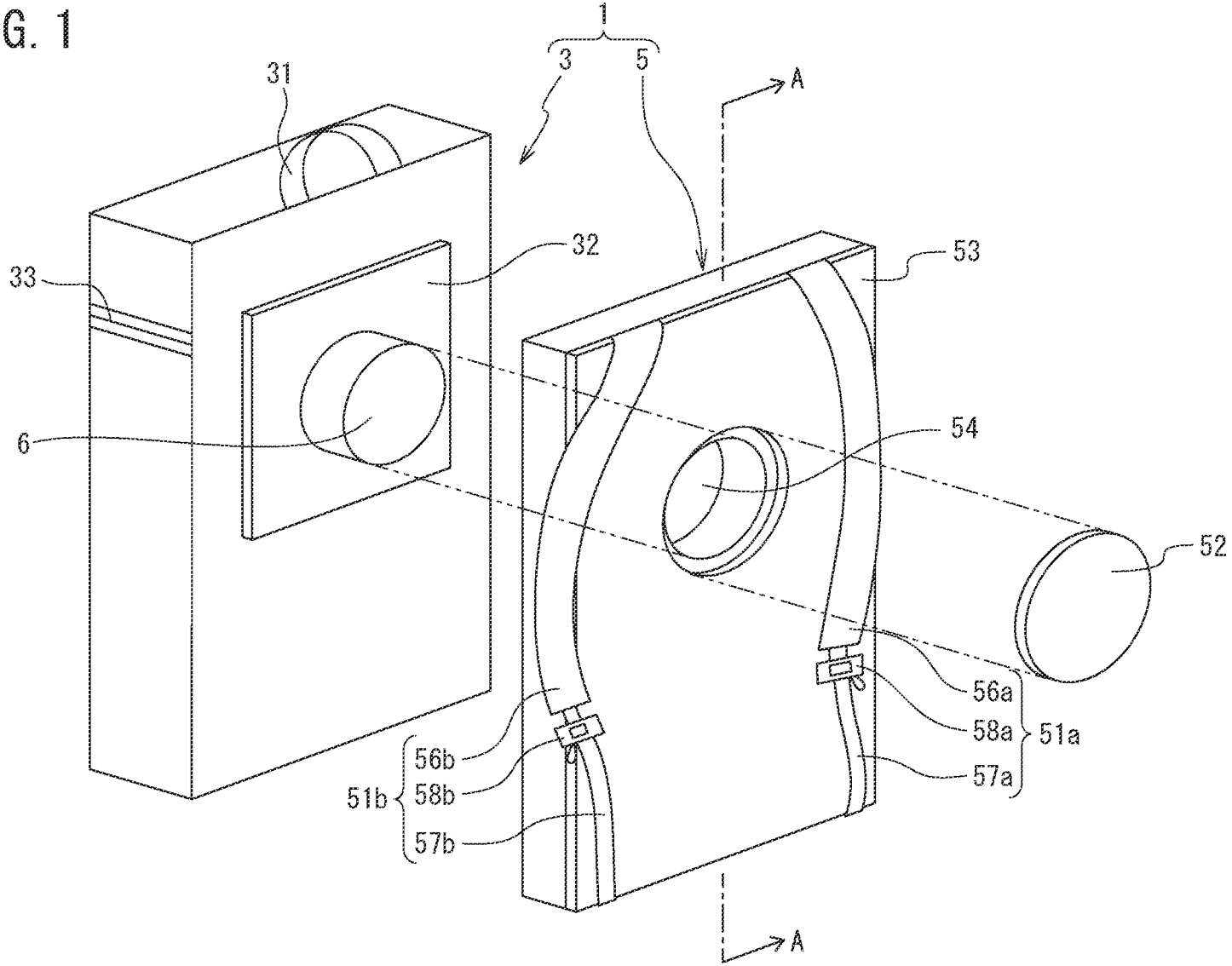
FIG. 1 is a perspective view illustrating a backpack according to a first embodiment in a state of separating a storage-compartment from a back plate.

Backpacks according to a first embodiment, a second embodiment and a plurality of modifications of the present invention will be hereinafter described with reference to the accompanying drawings. The same or similar reference numerals are applied to the same or similar parts and elements throughout the drawings. However, the drawings are merely schematic, and attention should be paid to a fact that the ratio of the sizes and the like of each part in the drawings differ from real data of the real products.

Therefore, the specific sizes of the specific storage-compartment, back plate, shoulder strap, etc., should be determined by considering the following explanation. Also, in the same part, it is natural that even between mutual drawings, the portions in which the relations and ratios between the mutual dimensions are different are included. Furthermore, backpacks according to the first embodiment, the second embodiment and the plurality of modifications described below are examples of structures or manufacturing methods of products or goods for realizing the technical idea of the present invention, and the technical idea of the present invention is not specified the quality of the material, form, contexture, arrangement, etc., of component parts as the following. Various changes can be added to the technical idea of the present invention scope indicated to the claims.

First Embodiment

As illustrated in FIG. 1, a backpack 1 according to a first embodiment of the present invention encompasses a box-shaped storage-compartment 3 and a back plate 5 which supports the storage-compartment 3 configured to be removable from the storage-compartment 3. The storage-compartment 3 has a box-shaped structure implemented by first and second main surfaces opposite to each other, and triple side-surfaces. The triple side-surfaces connect triple continuous sides defined to the first main surface and the counterpart triple continuous sides assigned to the second main surface opposite to the triple continuous sides of the first main surface. The back plate 5 has a plate-shaped structure, and has a joint plane opposite to the first main surface and a backrest plane (backside-surface) opposite to and parallel with the joint plane. The back plate 5 has a pair of shoulder straps (51*a*, 51*b*), which bridges from an upper portion of the backrest plane of the back plate 5 to double sites located at a lower portion of the backrest plane. For example, the pair of shoulder straps (51*a*, 51*b*) can establish a configuration spreading from a site around a center of the upper portion of the backrest plane toward double sites located at left and right sides of the lower portion of the backrest plane, by connecting between the site around the center of the upper portion of the backrest plane of the back plate 5 and the sites at the left and right sides of the lower portion of the backrest plane. Further, the pair of shoulder straps (51*a*, 51*b*) may establish a cross-topology or an almost parallel topology, by bridging to intersect or in parallel from double sites at the upper portion of the backrest plane toward the double sites at the lower portion of the backrest plane.

Specifically, as illustrated in FIG. 1, the first shoulder strap 51*a* may include a first shoulder belt 56*a* which is connected to the upper portion of the back plate 5, a first lower belt 57*a* which is connected to the site located at the lower portion of the back plate 5, and a first fastener 58*a*. The first fastener 58*a* connects the first shoulder belt 56*a* and the first lower belt 57*a* to each other. Similarly, the second shoulder strap 51*b* may include a second shoulder belt 56*b* which is connected to the upper portion of the back plate 5, a second lower belt 57*b* which is connected to the site located at the lower portion of the back plate 5, and a second fastener 58*b*. The second fastener 58*b* connects the second shoulder belt 56*b* and the second lower belt 57*b* to each other. One of the lengths of the shoulder belts 56*a*, 56*b* or the lengths of the lower belts 57*a*, 57*b* may be set to be adjustable by the fasteners 58*a*, 58*b*, or alternatively, both lengths of the shoulder belts 56*a*, 56*b* and the lower belts 57*a*, 57*b* may be adjusted by the fasteners 58*a*, 58*b*, when using the fasteners 58*a*, 58*b*. The lower belts 57*a*, 57*b* may be given a freedom of movements, by providing round-shaped attachments, such as daruma-rings, at the connection portions between the lower belts 57*a*, 57*b* and the counter-part double sites located at the lower portion of the back plate 5.

Figure 4:
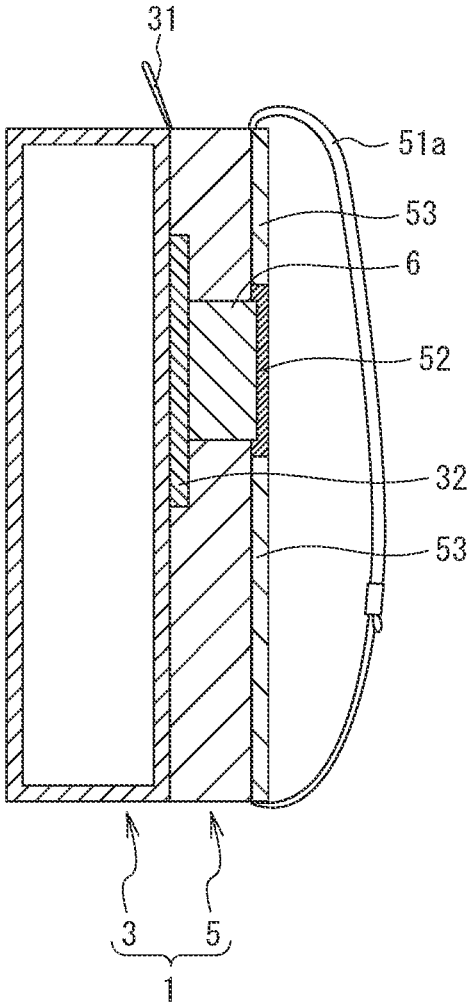
FIG. 4 is a cross sectional view taken on line A-A of FIG. 3.

Furthermore, various back-rings may be provided at the connection portion between the upper portion of the back plate 5 and the first shoulder belt 56*a*, and the connection portion between the upper portion of the back plate 5 and the second shoulder belt 56*b*. In addition, connections of the first shoulder belt 56*a* and the second shoulder belt 56*b* to the back plate 5 may be achieved by sewing method, configured to sew the first shoulder belt 56*a* and the second shoulder belt 56*b* respectively on the back plate 5, and may be achieved by adhering method with adhesives, etc. In the storage-compartment 3, as illustrated in FIG. 1, the first main surface shall indicate a surface on which the pedestal 32 is attached, and the first main surface is a surface opposite to the joint plane of the back plate 5. The first main surface has a rectangle shape in FIG. 1 and has the same shape to the second main surface whose illustration is omitted in FIG. 1. Although the joint plane is not illustrated in FIG. 1 as the joint plane is located at the backside of the back plate 5, the cross-sectional views of the joint plane, which is opposite to the first main surface of the storage-compartment 3, and the backrest plane which is parallelly opposite to the joint plane are illustrated in FIG. 4. The backrest plane illustrated in FIG. 1 is sketched as a main surface disposed at near and right side of the paper, and an insertion hole 54 is illustrated in the main surface, cutting and penetrating the backrest plane. A backrest cushion pad 53 is located on the backrest plane according to the representation illustrated in FIG. 1.

The storage-compartment 3 is a principal body which stores goods as carrying objects of the backpack 1, and has quadruple side-surfaces in addition to the first and second main surfaces. One of the quadruple side-surfaces is a bottom surface (bottom) of the storage-compartment 3, and an opposed side-surface disposed opposite to the bottom surface, among the quadruple side-surfaces, implements a top flap serving as a covering piece of the storage-compartment 3. Strictly speaking, as it is clear from FIG. 1, the top flap as the covering piece of the storage-compartment 3 has a side-surface opposite to the bottom, as the covering main portion. And the top flap encompasses a part of two side-surfaces continuously connected with the side-surface as the covering main portion, and a portion of an upper side of the second main surface. Therefore, the second main surface, a part of the triple side-surfaces, a lower part of the first main surface implement "the principal body" of a box-shape, when considering a structure of the backpack 1, which is separated into "the principal body" and "the covering piece". Here, the part of the triple side-surfaces includes triple pieces of surfaces which mutually connect at least one part of the triple continuous sides of the first main surface with at least one part of the triple continuous sides of the second main surface opposite to the triple sides of the first main surface.

However, a scheme of separating "the principal body" and "the covering piece" in FIG. 1 is merely one example of the structure of the backpack, it should be noted that it is possible to change a relationship between "the principal body" and "the covering piece", which implement the backpack 1, variously. For example, the covering piece may be provided on the bottom side of the backpack 1, and furthermore, the covering piece may have a structure with a first covering piece of the upper side of the backpack 1 and a second covering piece of the bottom side of the backpack 1. Still furthermore, the covering piece may be provided on the side-surface which is parallel with the gravitational vertical direction, or alternatively, the covering piece may be provided on the second main surface.

Figure 16:
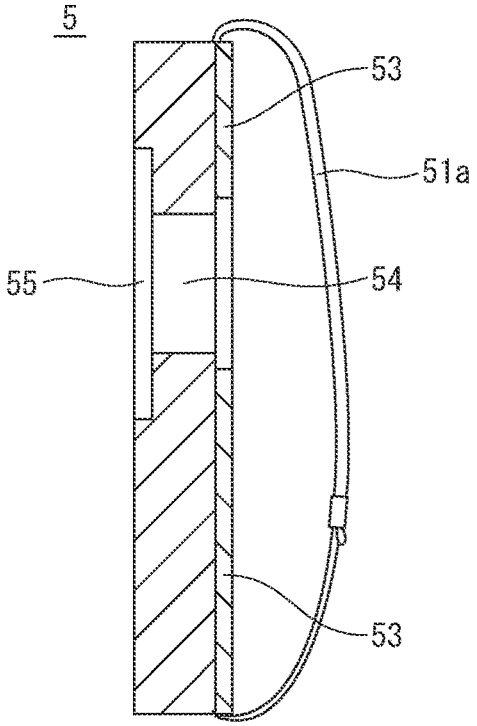
FIG. 16 is a cross sectional view of the back plate according to the first embodiment, taken on line A-A.
Figure 17:
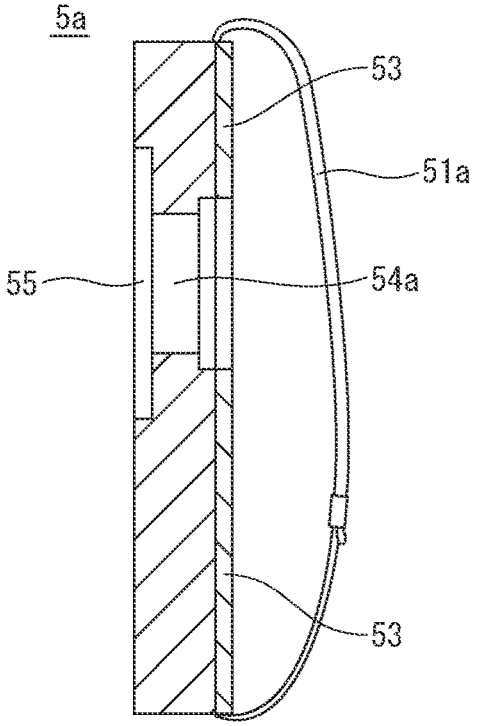
FIG. 17 is a cross sectional view illustrating a back plate according to the other modification of the first embodiment of FIG. 1.

Returning to the structure example illustrated in FIG. 1, the rectangle shaped pedestal 32 is disposed at the upper side along the center of the first main surface of the storage-compartment 3, and a convex element (first convex element) 6 having a cylindrical shape, for combining the storage-compartment 3 with the back plate 5, is provided on the rectangle shaped pedestal 32. The insertion hole (first insertion hole) 54 scheduled to be inserted by the convex element 6 is provided in the joint plane of the back plate 5, corresponding to the location and the size of the convex element 6. As illustrated in FIG. 16, the insertion hole 54 is cut from the joint plane to the backrest plane, passing through the back plate 5. With respect to the inner diameter of the insertion hole 54, an inner diameter at the joint plane is smaller than an inner diameter measured at a level of a stepped inner recess in the backrest plane side. Therefore, as illustrated in FIG. 2B and FIG. 16, the insertion hole 54 is a hole having a stepped inner structure at a shallow position near the backrest plane, when viewed from the backrest plane side. As illustrated in FIG. 4, the backpack 1 according to the first embodiment encompasses a fixing lid (first fixing lid) 52 as "the fixing mechanism (first fixing mechanism)" which fixes the convex element 6 to the back plate 5. The fixing lid 52 has a cap-like (hat-like) circular shape and can be connected to the end piece of the convex element 6 removably. And the fixing lid 52 cannot pass through the insertion hole 54 because the periphery of the fixing lid (cap) 52 has an outer diameter which is larger than the inner diameter of the insertion hole 54 at the joint plane. It is preferable that the outer diameter of the periphery of the fixing lid (cap) 52 is almost equal to the inner diameter of the stepped inner recess provided at the shallow position of the insertion hole 54 near the backrest plane, such that the outer diameter facilitate a fitting of the fixing lid into the stepped inner recess with close tolerance. The storage-compartment 3 having the convex element 6 is fixed to the back plate 5, by combining the end piece of the convex element 6 with the back plate 5, after cylindrically covering the end piece of the convex element 6 with the side crown of the cap, implementing the fixing lid 52, from the backrest plane side.

Figure 3:
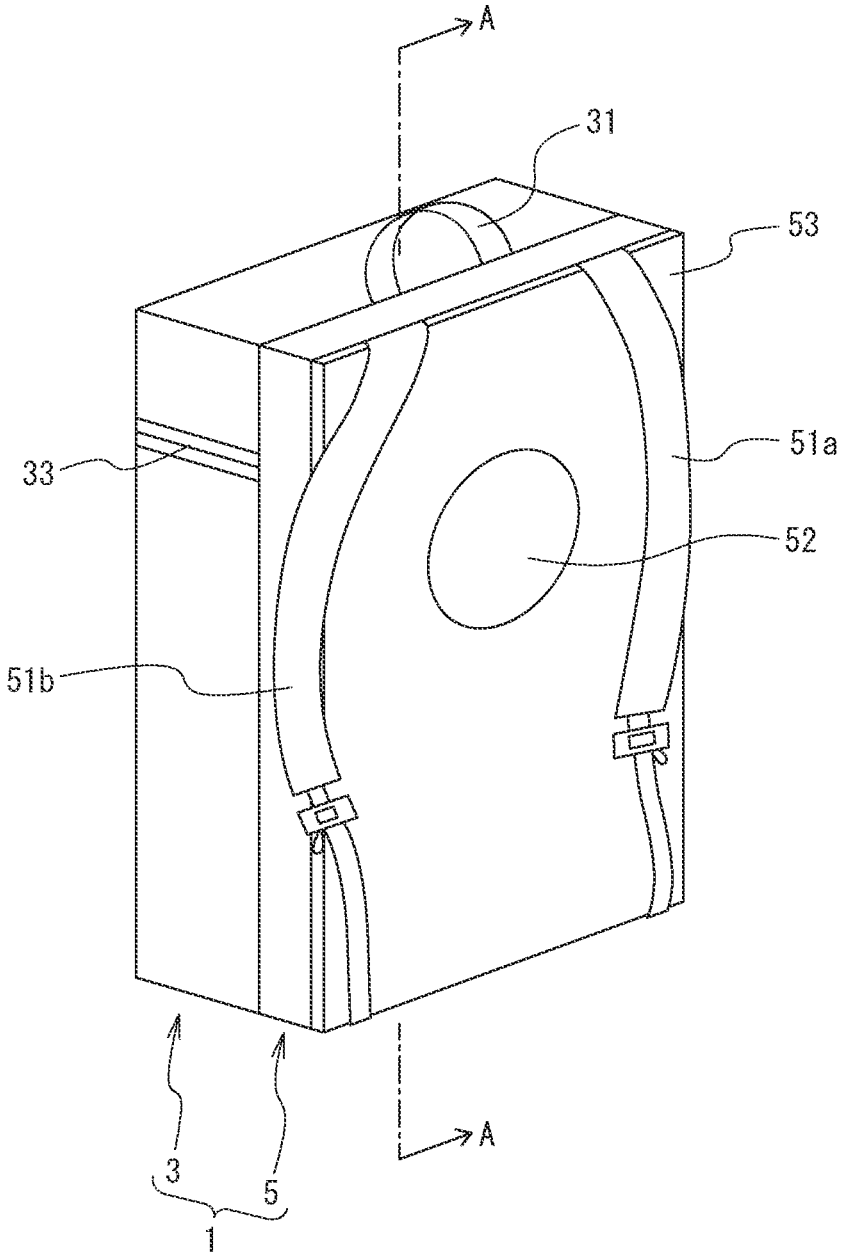
FIG. 3 is a perspective view illustrating the backpack according to the first embodiment.

Hereafter, some examples of the fixing methods for fixing the storage-compartment 3 to the back plate 5 are described below. As guessed from FIG. 4, a method is possible that a screw thread of a male screw is provided on the periphery surface of the pillar which implements the convex element 6, and the cap-like fixing lid 52 is screwed onto the end piece of the convex element 6. To realize the screwing scheme, the fixing lid 52 need to have a groove of a female screw, corresponding to the screw thread of the male screw of the convex element 6, inside the side crown of the cap of the fixing lid 52. And the side crown of the fixing lid 52 is fixed, by rotating the screw, which is provided in the side crown, around the end piece of the convex element 6, when combining the fixing lid 52 with the end piece of the convex element 6, and fixing the convex element 6 to the back plate 5 from the backrest plane side. As illustrated in FIG. 3, also when separating the storage-compartment 3 from a state in which the storage-compartment 3 is fixed to the back plate 5, the separating process (detachment process), namely, the reverse procedure against the fixing process (attachment process) can be executed. That is, it is possible that the fixing lid 52 is detached by rotating the fixing lid 52 in a detaching direction, the convex element 6 is pulled out from the insertion hole 54, and the storage-compartment 3 is separated from the back plate 5. In the other embodiments and the other modifications, when a storage-compartment or a back plate encompasses a convex element, the storage-compartment can be attached to or detached from the back plate in the same operation by using the material with the same mechanism as above.

Also, as the other method of fixing the storage-compartment 3 to the back plate 5, it is possible to fix the storage-compartment 3 to the back plate 5 by using the frictional force generated between the convex element 6 and the fixing lid 52, instead of providing the screw thread and the groove. Also, without using the mere frictional force, by providing a ring-shaped (O-ring shaped) protruding portion on the peripheral surface of the convex element 6, and by providing a ring-shaped concave, which conforms to the ring-shaped protruding portion, in the inner diameter side of the fixing lid 52, the concave and the protruding portion may be fitted each other using the elastic force. Furthermore, as the other method of fixing the storage-compartment 3 to the back plate 5, it is possible to employ magnetically susceptible materials which couple with each other by the magnetic force, such as metallic materials, as the materials for convex element 6 and the fixing lid 52, and then the storage-compartment 3 and the back plate 5 are connected each other by the magnetic force.

Because the backrest cushion pad 53 located on the backrest plane of the back plate 5 illustrated in FIG. 3 and FIG. 4 has cushion-like functions, it is possible to hook or claw one's finger, etc., to the fixing lid 52 when detaching the fixing lid 52, by denting and concaving a peripheral portion of the backrest cushion pad 53 around the fixing lid 52, after pushing the peripheral portion of the insertion hole 54 with one's finger, etc. In the above mechanism for denting and concaving the peripheral portion of the backrest cushion pad 53, as illustrated in FIG. 3 and FIG. 4, it is easily applicable to the case of having no space between the side crown of the fixing lid 52 and the insertion hole 54. Of course, it is possible to facilitate hooking one's finger and the like at the time of detaching the fixing lid 52, by a clearance of about one to five millimeters set between the side crown of the fixing lid 52 and the insertion hole 54. Also, the clearance of about one to five millimeters makes it easy to hold the fixing lid 52 with one's finger, etc. and to detach, when the detachment of the fixing lid 52.

Also, regarding the circular head portion of the fixing lid 52, instead of the flat shape as illustrated in FIG. 3, etc., it is possible to accept a shape with a groove and roughness. It is possible to facilitate detachment when the groove and roughness are provided on the head portion of the fixing lid 52, because it is easy to hook one's finger and the like. For example, a circular groove with a diameter smaller than the cap-like peripheral portion of the fixing lid 52 may be provided on a central area of the head portion of the fixing lid 52, and so on. Furthermore, a peripheral edge of the head portion of the fixing lid 52 may be beveled so that a valley can be established at a boundary between the fixing lid 52 and the insertion hole 54. Anyway, because the head portion of the fixing lid 52 may be contacted directly on the user's back, it is preferable that the head portion of the fixing lid 52 does not cause user a discomfort and uneasiness on user's back. Therefore, it is preferable that the head of the fixing lid 52 is not a large protrusion.

It is preferable that the convex element 6 has such a height which is exactly settled in the insertion hole 54 without projecting from a surface level of the extension surface of the backrest plane, when inserting the convex element 6 to the insertion hole 54. And, as to the fixing lid 52, it is preferable that the fixing lid 52 does not project from the surface level of the extension surface of the backrest plane, when the convex element 6 passes through the insertion hole 54 and the fixing lid 52 is connected to the end piece of the convex element 6. In FIG. 1, although the backrest cushion pad 53 is located at the backrest plane, it is preferable that the fixing lid 52 does not project from the backrest cushion pad 53 as illustrated in a cross-sectional view of FIG. 4. As another structural example that the fixing lid 52 does not project from the surface level of the extension surface of the backrest plane, the back plate 5*a* according to the other modification of the first embodiment encompasses a stepped inner recess, for installing the side crown of the fixing lid 52 in the inner diameter of the insertion hole 54, provided at a location deeper than the bottom level of the backrest cushion pad 53.

When a material of the fixing lid 52 is a metal with a poor corrosion resistance, such as iron, there is some possibility of generating a rust, and therefore, there is some possibility of getting the user's clothes, etc. dirty, when the rusted fixing lid 52 is used. So, the material of the fixing lid 52 must be non-rusty material, and is preferable to be reinforced plastic, stainless steel, titanium, etc. The same is true of the convex element 6 connected to the fixing lid 52.

Regarding the location of the convex element 6 in a gravitational vertical direction—upper and lower directions—, as illustrated in FIG. 1, etc., it is preferable that the convex element 6 is located at a position in a range of upper half of the first main surface from a viewpoint of a loading stability at the time of storing some contents in the storage-compartment 3. For example, it is preferable that the storage-compartment 3 can keep a balance and a loading stability, even if the contents with maximum weight is stored in the storage-compartment 3. Also, similarly, from a viewpoint of the loading stability, it is preferable that the location of the convex element 6 in a horizontal direction is a center of a width of the first main surface.

Figure 2A:
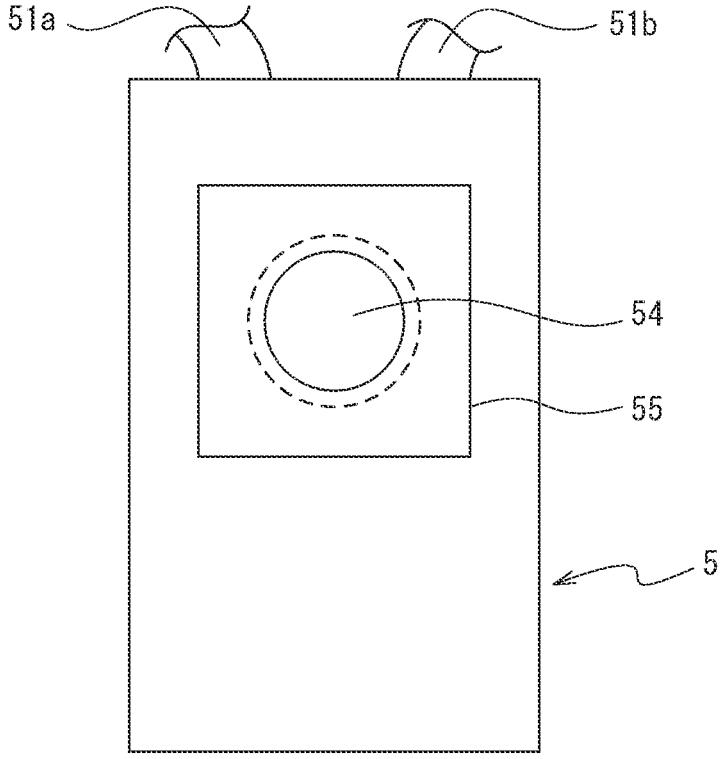
FIG. 2A is a diagram illustrating the back plate according to the first embodiment, viewed from a joint plane side.
Figure 2B:
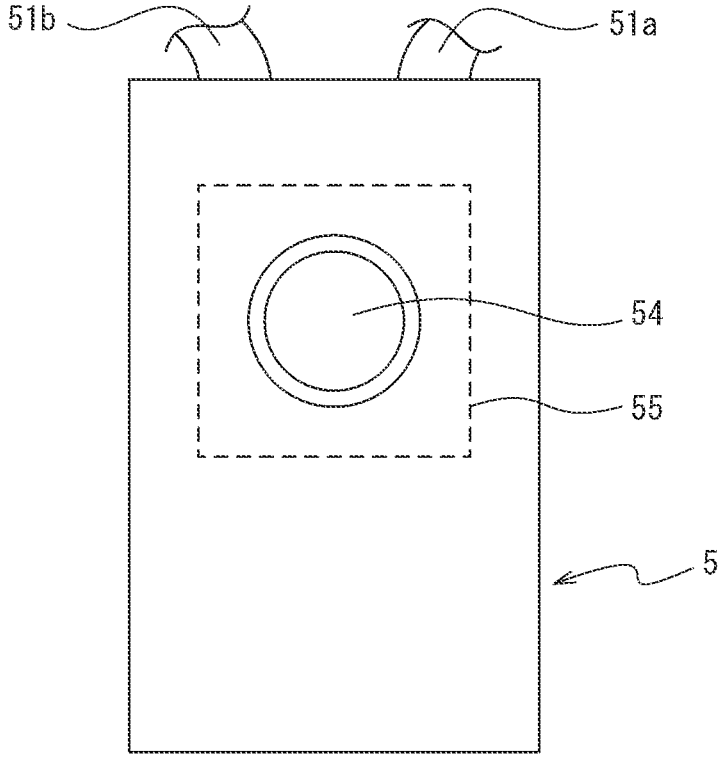
FIG. 2B is a diagram illustrating the back plate according to the first embodiment, viewed from a back surface side.

As illustrated in FIGS. 2A and 2B, the back plate 5 of the backpack 1 according to the first embodiment has the pedestal-storing depression 55 for storing and fixing the rectangle-shaped pedestal 32 on the joint plane. In FIG. 1, FIGS. 2A and 2B, etc., the pedestal-storing depression 55 is a rectangle-shaped concave having almost the same shape as the contour of the pedestal 32. The generation of rotary motion around the convex element 6 can be prevented, and, the storage-compartment 3 and the back plate 5 can be combined, by fitting the rectangle-shaped pedestal 32 in an inner space of the rectangle-shaped pedestal-storing depression 55. As illustrated in FIG. 3 and FIG. 4, the rattling can be reduced, when using the backpack 1 combining the storage-compartment 3 with the back plate 5, by setting an inner size including a size of the inner diameter of the insertion hole 54 of the pedestal-storing depression 55 almost equal to an outer size of the outer diameter, etc., of the convex element 6. However, it is natural that a predetermined clearance of one to three millimeters is provided between the pedestal-storing depression 55 and the pedestal 32, for facilitating the attachment and detachment of the storage-compartment 3 and the back plate 5 each other. Here, the pedestal-storing depression 55 is a blind hollow and does not pass through to the backrest plane 55, for preventing uncomfortable carrying of the back plate 5 on the user's back. Therefore, as illustrated in FIG. 2B, when viewing the back plate 5 from the backrest plane side, the pedestal-storing depression 55 is out of sight, but only the first shoulder strap 51*a*, the second shoulder strap 51*b*, the backrest cushion pad 53 and the insertion hole 54 with the stepped recess can be in sight.

Regarding the shape of the pedestal 32 and the pedestal-storing depression 55, some shapes other than the rectangle-shape are applicable, except a perfect circle. For example, the pedestal 32 may have a triangle-shape, an elliptical shape, a star-like shape, etc., and the pedestal-storing depression 55 also may have a shape corresponding to the shape of the pedestal 32. That is, any shapes are applicable unless the rattling and the rotation of the pedestal 32 occurs when the pedestal 32 is fitted in the pedestal-storing depression 55.

As the material of the pedestal 32, it is preferable that the pedestal 32 is made of stainless steel from a viewpoint of corrosion resistance, and that the pedestal 32 is made of titanium (Ti) or a titanium alloy from a viewpoint of corrosion resistance and a weight saving. As a material of the pedestal 32, a metal with poor corrosion resistance, such as iron (Fe), is not preferable, because there is some possibility of generating a rust. Moreover, the pedestal 32, and the convex element 6 of the center of the pedestal 32 may be integrated by molding. Or the pedestal 32 and the convex element 6 may be constructed as the different components. In the case that the pedestal 32 and the convex element 6 are implemented by different components, a method of opening quadruple insertion holes at the quadruple corners of the convex element 6, respectively, and fixing the convex element 6 to the pedestal 32, by passing through the screws into the quadruple insertion holes, is applicable. When the pedestal 32 and the convex element 6 are designed to be implemented by different components, it is preferable to give the users the freedoms of choice, so that the users can select materials, colors, etc., of the convex element 6 and pedestal 32 optionally, and can enjoy the selection of components.

As illustrated in FIG. 3, the backpack 1 encompasses the first shoulder strap 51*a* and the second shoulder strap 51*b* as the members for putting through both arms of the user, when the user carries the backpack 1 according to the first embodiment in a state of combining the storage-compartment 3 with the back plate 5. It is preferable that the material of the back plate 5 is a polycarbonate material, a carbon fiber material, aluminum (Al), a titanium material, etc., in order to make the back plate 5 lightweight. Also, the back plate 5 may be a member having a cavity component, if the strength during use can be kept enough. In the backpack 1 of the first embodiment, the backrest cushion pad 53 is provided to the back plate 5 so that the fixing lid 52 does not directly touch user's body too much when the user carries the backpack 1, therefore, a thickness is given to the backrest cushion pad 53 so that an enough elasticity—or an enough cushioning characteristic—can be achieved. The shape of the backrest cushion pad 53 may be an order-made shape with various rounded planes, or uneven planes corresponding to the user's shapes of backs. As a result, it is possible to realize the backpack 1 being more suitable for the personal body shape, and to realize the effect that the physical burden of the user can be reduced. As the buffer materials of the backrest cushion pad 53, in the composite structure of a skin layer or inside layers, polyethylene is preferable, because the polyethylene has an excellent air-permeability, drying sweat quickly, and therefore, the effectiveness that the backrest cushion pad 53 can keep user comfortable is achieved.

Also, assuming a case of getting wet by sweat, rain, etc., regarding the materials of the first shoulder strap 51*a* and the second shoulder strap 51*b*, hygroscopic quick-drying polyethylene is suitable. Instead of polyethylene, the first shoulder strap 51*a* and the second shoulder strap 51*b* can be made of synthetic leather or real leather from the aspect of beauty. Furthermore, the first shoulder strap 51*a* and the second shoulder strap 51*b* may further include chest straps or waist belts. By adding the chest straps or the waist belts to the backpack 1 according to the first embodiment, the advantageous effects such that the loading stability of the backpack 1 is improved more, and therefore, the fatigue of the user is reduced more, compared with a case of carrying the backpack 1 with only the first shoulder strap 51*a* and only the second shoulder strap 51*b*—two straps only—. Also, when using the backpack 1 which has fixed the storage-compartment 3 to the back plate 5, the user shall pass the user's both arms through the first shoulder strap 51*a* and the second shoulder strap 51*b*, respectively, and then, shall carry the backpack 1 on the user's back as in the earlier method for carrying backpack.

In addition, in the backpack 1 pertaining to the first embodiment, the top handle 31, or the handle mechanism of the backpack 1, for hanging the backpack 1 to the hook, etc., of the locker, etc., is provided at a location corresponding to the back ring of the back plate 5. Top handle 31 also can be used when carrying the backpack 1 without carrying the backpack 1 on the user's back. Also, according to the purpose of backpack's use, other handle may be provided at the location other than the location of the top handle 31 illustrating in FIG. 1. Furthermore, according to the backpack 1 pertaining to the first embodiment, by adding the handles, the advantageous effect such that carrying of the backpack 1 becomes easier can be achieved.

In FIG. 1, a part of the fastener 33 for putting the storing-articles—goods or items to be stored—in the backpack 1 or out from the backpack 1 is illustrated at the upper portion of the side-surface of the storage-compartment 3. The fastener 33 of the backpack 1 according to the first embodiment is constructed so that the upper portion of the storage-compartment 3 can be opened or closed, by moving the fastener 33 from a left side-surface toward a right side-surface, which faced to the left side-surface, passing through the second main surface, or alternatively, the upper portion of the storage-compartment 3 can be opened or closed, by moving the fastener 33 from a right side-surface toward a left side-surface, which faced to the right side-surface, passing through the second main surface, in the upper portion of the storage-compartment 3. The upper portion of the storage-compartment 3 separated by the fastener 33 is corresponding to the covering sheet (covering piece) of the school backpack. Also, the fastener 33 may be provided at the location other than the location illustrated in FIG. 1, etc., according to modes of the backpack's use. Furthermore, the member for opening and closing the opening portion may be any element other than the fastener 33. It is preferable that the storage-compartment 3 of the backpack 1 according to the first embodiment is polycarbonate, a hood material with water resistance, a carbon fiber, polyethylene, etc., for protecting the storing-articles from rain, snow, etc.

Also, regarding the shapes of the storage-compartment 3, breaking all the conventional rules or common sense, miscellaneous and various shapes are available to the present invention as long as the location of the convex element 6 and the location of the back plate 5 are corresponding to each other. For example, it is possible that the shape of the storage-compartment 3 is triangular prism. As described above, the applying of the various shapes can cause the effectiveness of expressing the excellent and advanced fashion.

In addition, regarding the inside structure of the storage-compartment 3, a partition member, configured to divide an inner volume of the storage-compartment 3 into the upper portion and the lower portion, may be provided at the arbitrary portion in the inside of the backpack 1. Instead of providing such partition member, the backpack 1 may have a structure that the storing-articles, or the articles to be stored are contained freely in the range of the whole storage space freely. Furthermore, a free adhering structure, in which a surface morphology of the male side is raised hairy in a hook-like configuration and a surface morphology of the female side is raised hairy in a loop-like configuration with high density, can be employed. By the free adhering structure, when the male and female sides are pushed, the surfaces of the male and female sides adhere each other by the pushing only, at the superimposed portion of the male and female sides. And, like the employment of the surface fastener, the free adhering structure may be provided at the both ends of the partition plates and the both sides of the inside of the storage-compartment 3, so that the partition plates can be moved freely. Also, it may be able to carry a thin electronic equipment, for example, a tablet personal computer (PC), etc., safely, by using the material with cushioning materials in the inside of the storage-compartment 3, by partitioning in a vertical direction of the backpack 1.

Furthermore, according to the first embodiment, the effectiveness that the size of the storage-compartment 3 is exchangeable freely is obtained by preparing a plurality of options of storage-compartments, and by selecting one of the options as the storage-compartment 3, which has an arbitrary size among the options, as long as the location of the convex element of the pedestal 32 in the selected storage-compartment 3 and the location of the insertion hole 54 of the back plate 5 can be mated. For example, in the case of applying the backpack 1 illustrated in FIG. 1 to the school backpack for an elementary school student, the school knapsack which has the optimum size can be provided as growing up of the school student, by optionally selecting one option with a desired size among the plurality of options of storage-compartments. That is, if the plurality of options of storage-compartments is prepared enough, the user can select any school knapsack with the desired size as growing up, and therefore, the user can change the storage-compartment 3 or the back plate 5 to the other option of storage-compartment 3 or the other option of back plate 5, which matches to the body size of the school student.

According to the backpack 1 of the first embodiment, the storage-compartment 3 or the back plate 5 can be exchanged to the arbitrary storage-compartment or the arbitrary back plate among the plurality of options of storage-compartments or the plurality of options of back plates, by separating the storage-compartment 3 from the back plate 5 or by combining the storage-compartment 3 with the back plate 5, if the plurality of options of storage-compartments and the plurality of options of back plates are prepared. Also, another person or anyone else just happen to be the place can exchange the storage-compartment 3 to the other storage-compartment, while the user is carrying the backpack 1 according to the first embodiment, if the plurality of options of storage-compartments and the plurality of options of back plates are prepared.

As a result of adoptions of the above structures, the backpack 1 according to the first embodiment has variety, diverseness and multifariousness in the combination of the storage-compartment 3, the back plate 5, etc., and the degrees of freedom to select color, shape, etc., increases drastically. The variety of the combination can also bring economic advantages. The backpack 1 according to the first embodiment is very economical for user, because various situations will be sometimes occurred in user, such that the user is enough to prepare, or purchase either one of a new storage-compartment or a new back plate, when any backpack having a preferred appearance is desired to be owned.

First Modification of First Embodiment

Figure 5:
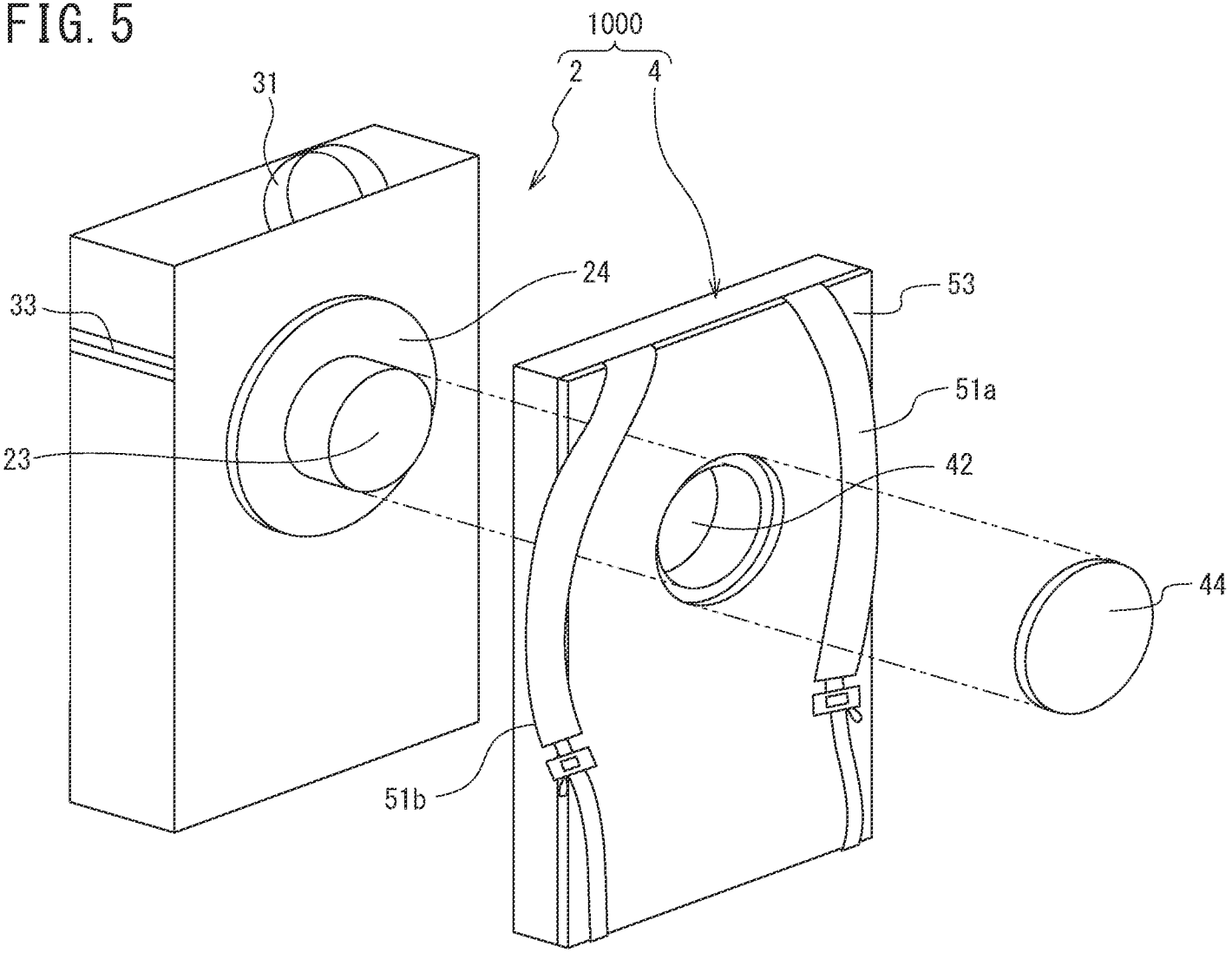
FIG. 5 is a perspective view illustrating a backpack according to a first modification of the first embodiment in a state of separating a storage-compartment from a back plate.

As illustrated in FIG. 5, a backpack 1000 according to a first modification of the first embodiment encompasses a box-shaped storage-compartment 2 and a back plate 4 removable from the storage-compartment 2. The storage-compartment 2 has a box-shaped structure implemented by first and second main surfaces opposite to each other, and triple side-surfaces. The triple side-surfaces connects triple continuous sides defined to the first main surface and the counterpart triple continuous sides assigned to the second main surface opposite to the triple continuous sides of the first main surface. The back plate 4 has a plate-shape structure, and has a joint plane opposite to the first main surface when combining to the storage-compartment 2 and a backrest plane opposite to the joint plane. The back plate 4 has a pair of shoulder straps (51*a*, 51*b*) bridging from an upper portion of the backrest plane to a lower portion of the backrest plane. In the backpack 1000 according to the first modification, a convex element 23 is provided on the first main surface, and an insertion hole 42 having a structure corresponding to the convex element 23 is provided in the location corresponding to the convex element 23 on the joint plane. Also, the attachment and the detachment of the storage-compartment 2 and the back plate 4 is freely achieved, by passing the convex element 23 through the insertion hole 42 and by pulling the convex element 23 out from the insertion hole 42.

In the backpack 1000 according to the first modification, schemes of combining the elements of the backpack 1000, structures, materials and usages of the storage-compartment 2 and the back plate 4, etc., are almost similar to the backpack 1 recited in the first embodiment. However, as illustrated in FIG. 5, the backpack 1000 according to the first modification is different from the backpack 1 according to the first embodiment, in the feature that the convex element 23 of the storage-compartment 2 has no pedestal. In addition, in the backpack 1000 according to the first modification, the thickness of the back plate 4 can be set thinner, because the backpack 1000 does not encompass an element corresponding to the pedestal-storing depression 55 of the back plate 5 of the first embodiment.

Figure 6:
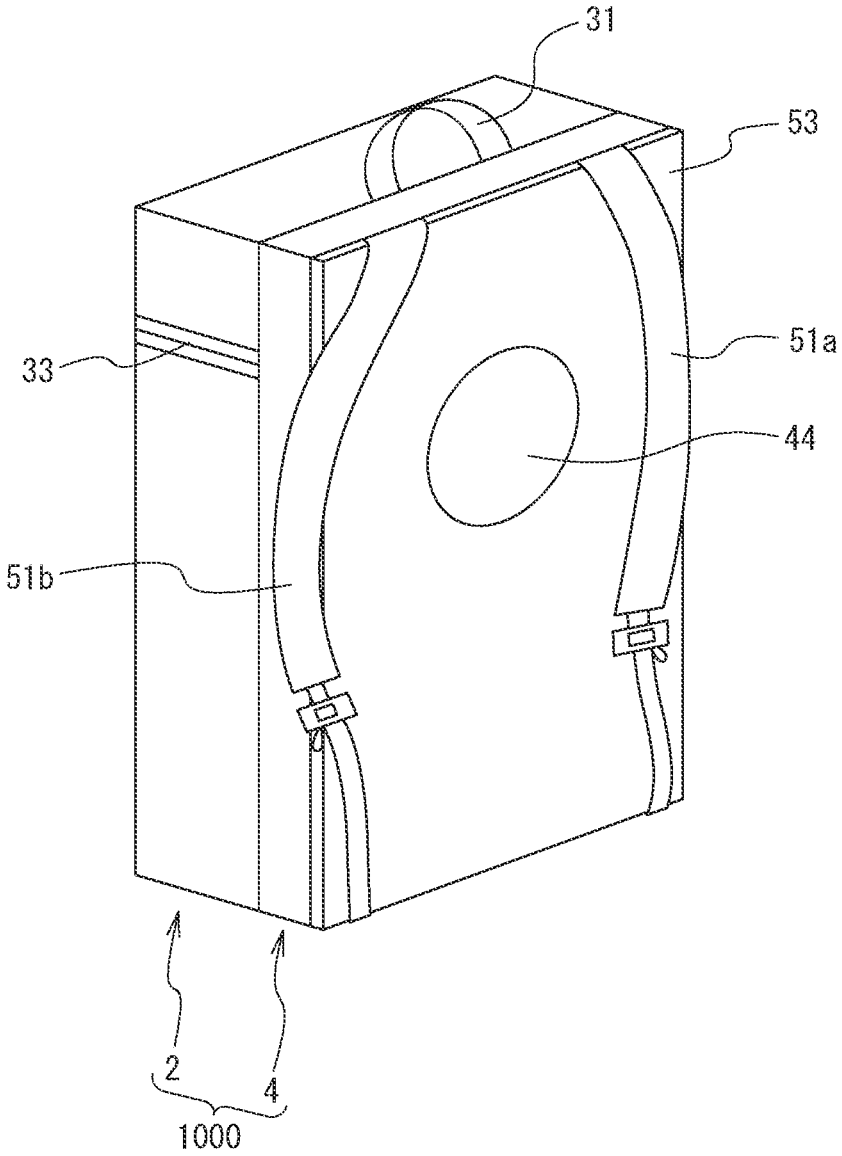
FIG. 6 is a perspective view illustrating the backpack according to the first modification.

As illustrated in FIG. 5, a ring-shaped washer 24 is attached around the convex element 23 provided on the storage-compartment 2. Also, when using the backpack 1000 according to the first modification, the convex element 23 is passed through the insertion hole 42 of the back plate 4, and the convex element 23 is fixed to the back plate 4 using the fixing lid 44. Therefore, as illustrated in FIG. 6, after fixing, the storage-compartment 2 can freely rotate against the back plate 4 around the axis of the convex element 23, because the washer 24 is intervened between the storage-compartment 2 and the back plate 4. In the case that the user inclines own body while carrying the backpack 1000 according to the first modification on the back, the storage-compartment 2 with increased weight by storing goods in the backpack, rotates, and is held so that the lower portion of the storage-compartment 2 is always located in the vertically downward. In the state that the lower portion of the storage-compartment 2 is located in the vertically downward, the effectiveness that it becomes easy to put goods out from the storage-compartment 2 compared with the backpack 1 according to the first embodiment, is achieved, because the user can reach own hands to the fastener 33 easily, and there is no problem that the goods in the storage-compartment 2 jumps out from the backpack 1000 against the user's will.

According to the backpack 1000 according to the first modification, similar to the backpack 1 according to the first embodiment, the storage-compartment 2 or the back plate 4 can be exchanged to the arbitrary storage-compartment or the arbitrary back plate among the plurality of options of storage-compartments or the plurality of options of back plates, by separating the storage-compartment 2 from the back plate 4 or by combining the storage-compartment 2 with the back plate 4, if the plurality of options of storage-compartments and the plurality of options of back plates are prepared. Also, another person or anyone else just happen to be the place can exchange the storage-compartment 2 to the other storage-compartment, while the user is carrying the backpack 1000 according to the first modification, if the plurality of options of storage-compartments and the plurality of options of back plates are prepared. As a result of adoptions of the above structures, similar to the backpack 1 according to the first embodiment, the backpack 1000 according to the first modification has variety, diverseness and multifariousness in the combination of the storage-compartment 2, the back plate 4, etc., and the degrees of freedom to select color, shape, etc., increases drastically. The variety of the combination can also bring economic advantages. The backpack 1000 according to the first modification is very economical for user, because various situations will be sometimes occurred in user, such that the user is enough to prepare, or purchase either one of a new storage-compartment or a new back plate, when any backpack having a preferred appearance is desired to be owned.

Second Modification of First Embodiment

Figure 7:
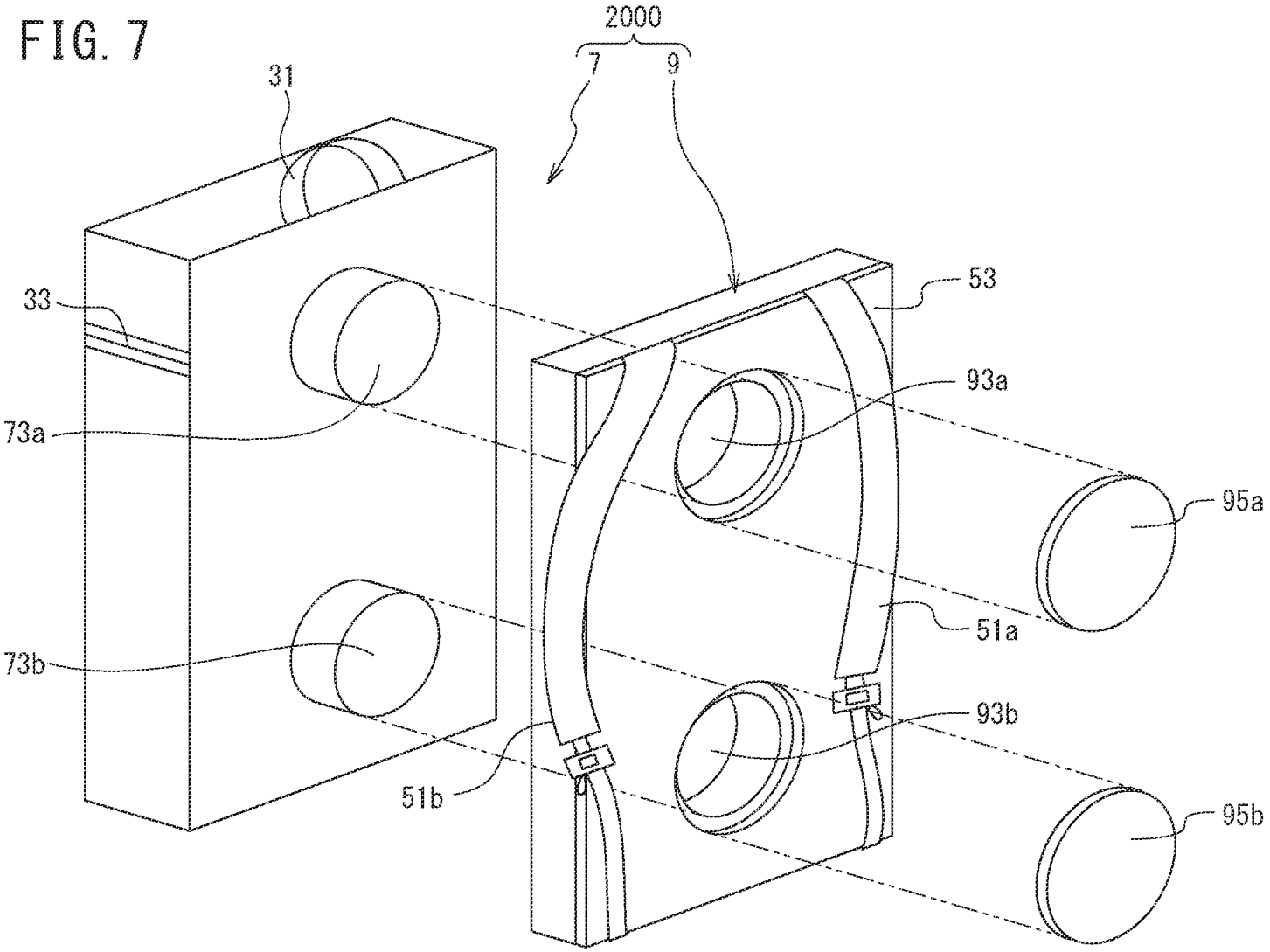
FIG. 7 is a perspective view illustrating a backpack according to a second modification of the first embodiment in a state of separating a storage-compartment from a back plate.

As illustrated in FIG. 7, a backpack 2000 according to a second modification of the first embodiment encompasses a box-shaped storage-compartment 7 and a back plate 9 removable from the storage-compartment 7. The storage-compartment 7 has a box-shaped structure implemented by first and second main surfaces opposite to each other, and triple side-surfaces. The triple side-surfaces connects triple continuous sides defined to the first main surface and the counterpart triple continuous sides assigned to the second main surface opposite to the triple continuous sides of the first main surface. The back plate 9 has a plate-shape structure, and has a joint plane opposite to the first main surface when combining to the storage-compartment 7 and a backrest plane opposite to the joint plane. The back plate 9 has a pair of shoulder straps (51*a*, 51*b*) bridging from an upper portion of the backrest plane to a lower portion of the backrest plane. In the backpack 2000 according to the second modification, a first convex element 73*a* is provided on the first main surface, and a first insertion hole 93*a* having a structure corresponding to the first convex element 73*a* is provided in the location corresponding to the first convex element 73*a* on the joint plane. In the backpack 2000 according to the second modification, a second convex element 73*b* is provided on the first main surface, and a second insertion hole 93*b* having a structure corresponding to the second convex element 73*b* is provided in the location corresponding to the second convex element 73*b* on the joint plane. Also, the attachment and the detachment of the storage-compartment 7 and the back plate 9 is freely achieved, by passing the first convex element 73*a* and the second convex element 73*b* through the first insertion hole 93*a* and the second insertion hole 93*b* respectively, and by pulling the first convex element 73*a* and the second convex element 73*b* out from the first insertion hole 93*a* and the second insertion hole 93*b* respectively. Furthermore, the backpack 2000 encompasses a first fixing lid 95*a* and a second fixing lid 95*b* for fixing the storage-compartment 7 to a back plate 9.

In the backpack 2000 according to the second modification, schemes of combining the elements of the backpack 2000, structures, materials and usages of the storage-compartment 7 and the back plate 9, etc., are almost similar to the backpack 1 recited in the first embodiment. However, the backpack 2000 according to the second modification is different from the backpack 1 according to the first embodiment, in the feature that the storage-compartment 7 and the back plate 9 does not have any pedestals connected with the convex elements and pedestal-storing depressions fitted to the pedestals. In addition, in the backpack 2000 according to the second modification, the thickness of the back plate 9 can be set thinner, because the backpack 2000 does not encompass any elements corresponding to the pedestal-storing depressions.

Figure 8:
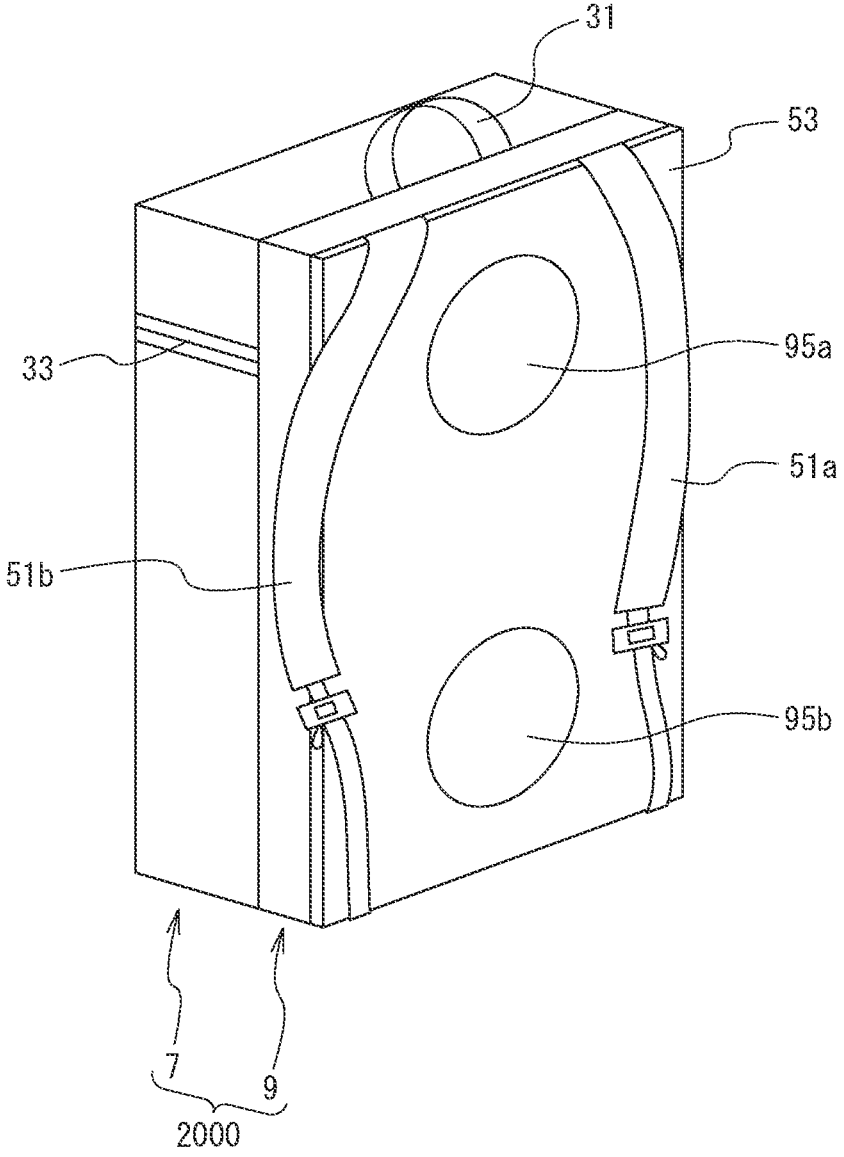
FIG. 8 is a perspective view illustrating the backpack according to the second modification.

Moreover, as illustrated in FIG. 7 and FIG. 8, the backpack 2000 according to the second modification is also different from the backpack 1 according to the first embodiment, in the feature that the positions for fixing the storage-compartment 7 and the back plate 9 are two. Since there are two fixing positions in the backpack 2000 according to the second modification, the backpack 2000 according to the second modification has a structure which is enough to withstand vibration or shock generated from user when the user moves, compared with the backpack 1 recited in the first embodiment. Also, according to the backpack 2000 of the second modification, the advantageous effect that the storage-compartment 7 can be fixed more strongly and more stably and the user can feel safe when carrying the backpack 2000, is achieved, compared with the backpack 1 recited in the first embodiment.

According to the backpack 2000 pertaining to the second modification, similar to the backpack 1 explained in the first embodiment, the storage-compartment 7 or the back plate 9 can be exchanged to the arbitrary storage-compartment or the arbitrary back plate among the plurality of options of storage-compartments or the plurality of options of back plates, by separating the storage-compartment 7 from the back plate 9 or by combining the storage-compartment 7 with the back plate 9, if the plurality of options of storage-compartments and the plurality of options of back plates are prepared. Also, another person or anyone else just happen to be the place can exchange the storage-compartment 7 to the other storage-compartment, while the user is carrying the backpack 2000 pertaining to the second modification, if the plurality of options of storage-compartments and the plurality of options of back plates are prepared. As a result of adoptions of the above structures, similar to the backpack 1 explained in the first embodiment, the backpack 2000 pertaining to the second modification has variety, diverseness and multifariousness in the combination of the storage-compartment 7, the back plate 9, etc., and the degrees of freedom to select color, shape, etc., increases drastically. The variety of the combination can also bring economic advantages. The backpack 2000 pertaining to the second modification is very economical for user, because various situations will be sometimes occurred in user, such that the user is enough to prepare, or purchase either one of a new storage-compartment or a new back plate, when any backpack having a preferred appearance is desired to be owned.

Third Modification of First Embodiment

Figure 9:
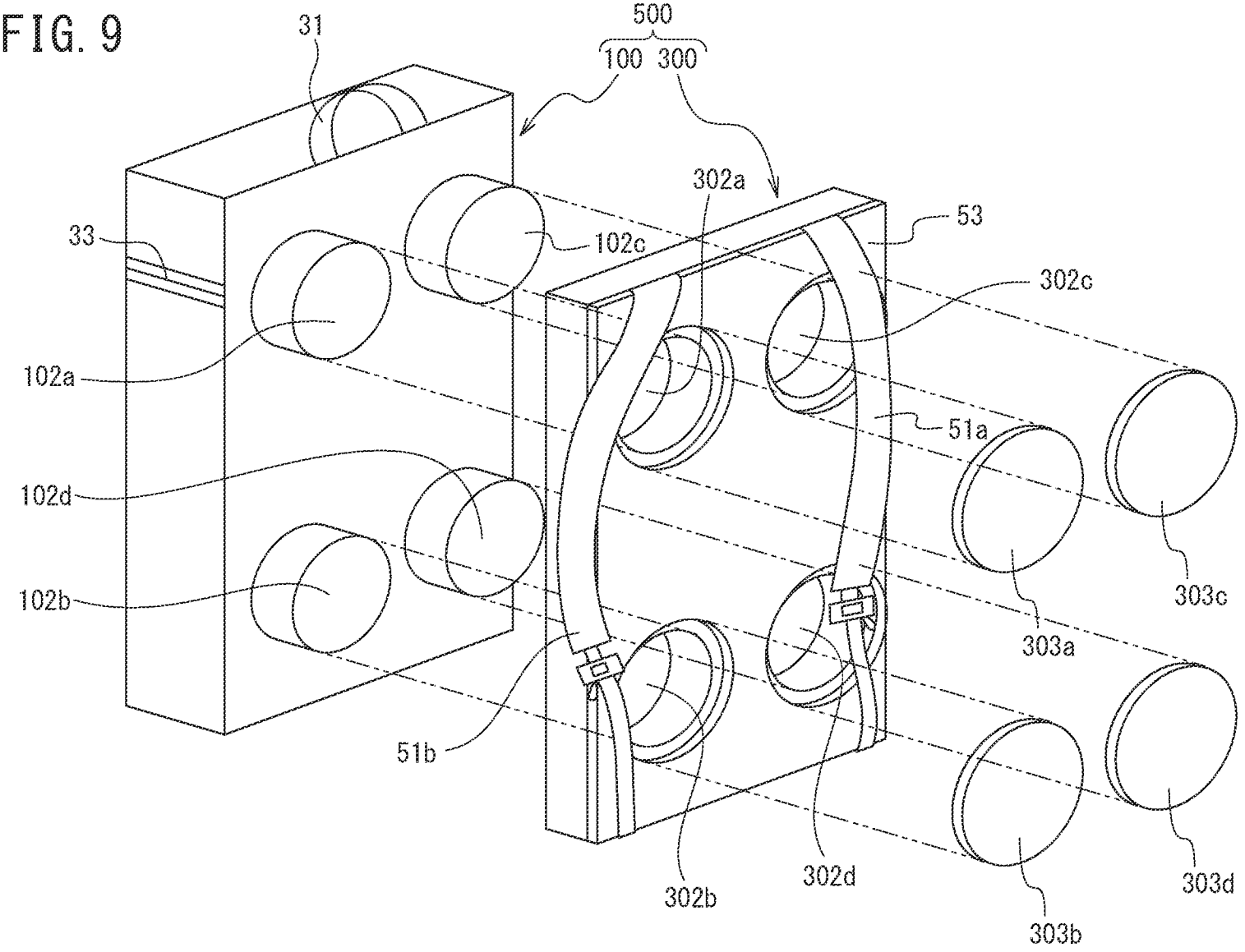
FIG. 9 is a perspective view illustrating a backpack according to a third modification of the first embodiment in a state of separating a storage-compartment from a back plate.

As illustrated in FIG. 9, a backpack 500 according to a third modification of the first embodiment encompasses a box-shaped storage-compartment 100 and a back plate 300 removable from the storage-compartment 100. The storage-compartment 100 has a box-shaped structure implemented by first and second main surfaces opposite to each other, and triple side-surfaces. The triple side-surfaces connects triple continuous sides defined to the first main surface and the counterpart triple continuous sides assigned to the second main surface opposite to the triple continuous sides of the first main surface. The back plate 300 has a plate-shape structure, and has a joint plane opposite to the first main surface when combining to the storage-compartment 100 and a backrest plane opposite to the joint plane. The back plate 300 has a pair of shoulder straps (51*a*, 51*b*) bridging from an upper portion of the backrest plane to a lower portion of the backrest plane. In the backpack 500 according to the third modification, a first convex element 102*a* is provided on the first main surface, and a first insertion hole 302*a* having a structure corresponding to the first convex element 102*a* is provided in the location corresponding to the first convex element 102*a* on the joint plane. In the backpack 500 according to the third modification, a second convex element 102*b* is provided on the first main surface, and a second insertion hole 302*b* having a structure corresponding to the second convex element 102*b* is provided in the location corresponding to the second convex element 102*b* on the joint plane. In the backpack 500 according to the third modification, a third convex element 102*c* is provided on the first main surface, and a third insertion hole 302*c* having a structure corresponding to the third convex element 102*c* is provided in the location corresponding to the third convex element 102*c* on the joint plane. In the backpack 500 according to the third modification, a fourth convex element 102*d* is provided on the first main surface, and a fourth insertion hole 302*d* having a structure corresponding to the fourth convex element 102*d* is provided in the location corresponding to the fourth convex element 102*d* on the joint plane. Also, the attachment and the detachment of the storage-compartment 100 and the back plate 300 is freely achieved, by passing the first convex element 102*a*, the second convex element 102*b*, the third convex element 102*c* and the fourth convex element 102*d* through the first insertion hole 302*a*, the second insertion hole 302*b*, the third insertion hole 302*c* and the fourth insertion hole 302*d* respectively, and by pulling the first convex element 102*a*, the second convex element 102*b*, the third convex element 102*c* and the fourth convex element 102*d* out from the first insertion hole 302*a*, the second insertion hole 302*b*, the third insertion hole 302*c* and the fourth insertion hole 302*d* respectively. Furthermore, the backpack 500 encompasses a first fixing lid 303*a*, a second fixing lid 303*b*, a third fixing lid 303*c* and a fourth fixing lid 303*d* at the end pieces of the first convex element 102*a*, the second convex element 102*b*, the third convex element 102*c* and the fourth convex element 102*d*, respectively.

In the backpack 500 according to the third modification, schemes of combining the elements of the backpack 500, structures, materials and usages of the storage-compartment 100 and the back plate 300, etc., are almost similar to the backpack 1 recited in the first embodiment. However, the backpack 500 according to the third modification is different from the backpack 1 explained in the first embodiment, in the feature that the storage-compartment 100 and the back plate 300 does not have any pedestals connected with the above four convex elements and a pedestal-storing depression fitted to the pedestals. In addition, in the backpack 500 according to the third modification, the thickness of the back plate 300 can be set thinner, because the backpack 500 does not encompass any elements corresponding to the pedestal-storing depressions.

Figure 10:
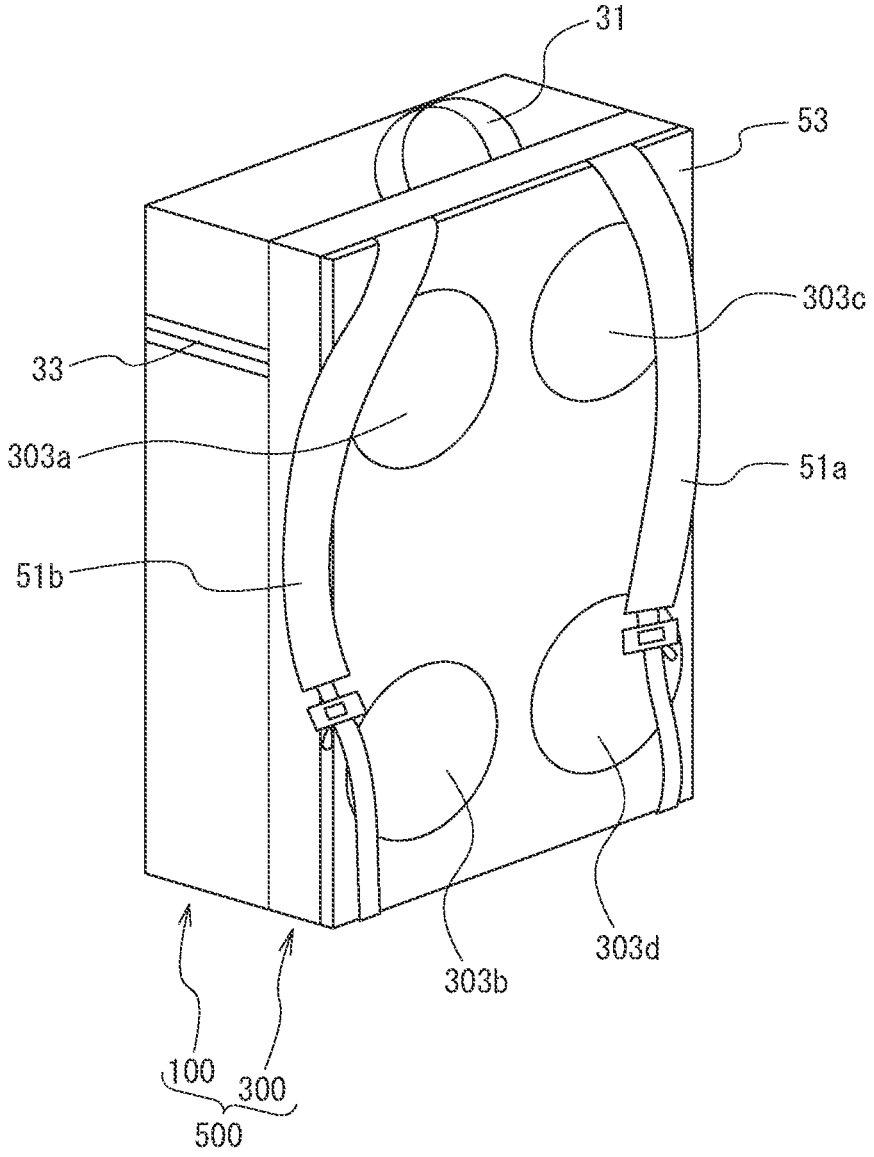
FIG. 10 is a perspective view illustrating the backpack according to the third modification.

Moreover, as illustrated in FIG. 9 and FIG. 10, the backpack 500 according to the third modification is also different from the backpack 1 explained in the first embodiment, in the feature that the positions for fixing the storage-compartment 100 and the back plate 300 are four. Since there are quadruple fixing positions in the backpack 500 according to the third modification, the backpack 500 according to the third modification has a structure which is enough to withstand vibration or shock generated from user when the user moves, compared with the backpack 1 recited in the first embodiment. Also, according to the backpack 500 of the third modification, the advantageous effect that the storage-compartment 100 can be fixed more strongly and more stably, and the user can feel safe when carrying the backpack 500, is realized, compared with the backpack 1 recited in the first embodiment. Furthermore, according to the backpack 500 of the third modification, the storage-compartment 100 can be fixed more strongly and more stably compared with the backpack 2000 explained in the second modification, because the backpack 500 according to the third modification has the fixing positions more than that of the backpack 2000 explained in the second modification.

According to the backpack 500 pertaining to the third modification, similar to the backpack 1 explained in the first embodiment, the storage-compartment 100 or the back plate 300 can be exchanged to the arbitrary storage-compartment or the arbitrary back plate among the plurality of options of storage-compartments or the plurality of options of back plates, by separating the storage-compartment 100 from the back plate 300 or by combining the storage-compartment 100 with the back plate 300, if the plurality of options of storage-compartments and the plurality of options of back plates are prepared. Also, another person or anyone else just happen to be the place can exchange the storage-compartment 100 to the other storage-compartment, while the user is carrying the backpack 500 pertaining to the third modification, if the plurality of options of storage-compartments and the plurality of options of back plates are prepared. As a result of adoptions of the above structures, similar to the backpack 1 explained in the first embodiment, the backpack 500 pertaining to the third modification has variety, diverseness and multifariousness in the combination of the storage-compartment 100, the back plate 300, etc., and the degrees of freedom to select color, shape, etc., increases drastically. The variety of the combination can also bring economic advantages. The backpack 500 pertaining to the third modification is very economical for user, because various situations will be sometimes occurred in user, such that the user is enough to prepare, or purchase either one of a new storage-compartment or a new back plate, when any backpack having a preferred appearance is desired to be owned.

Fourth Modification of First Embodiment

Figure 11:
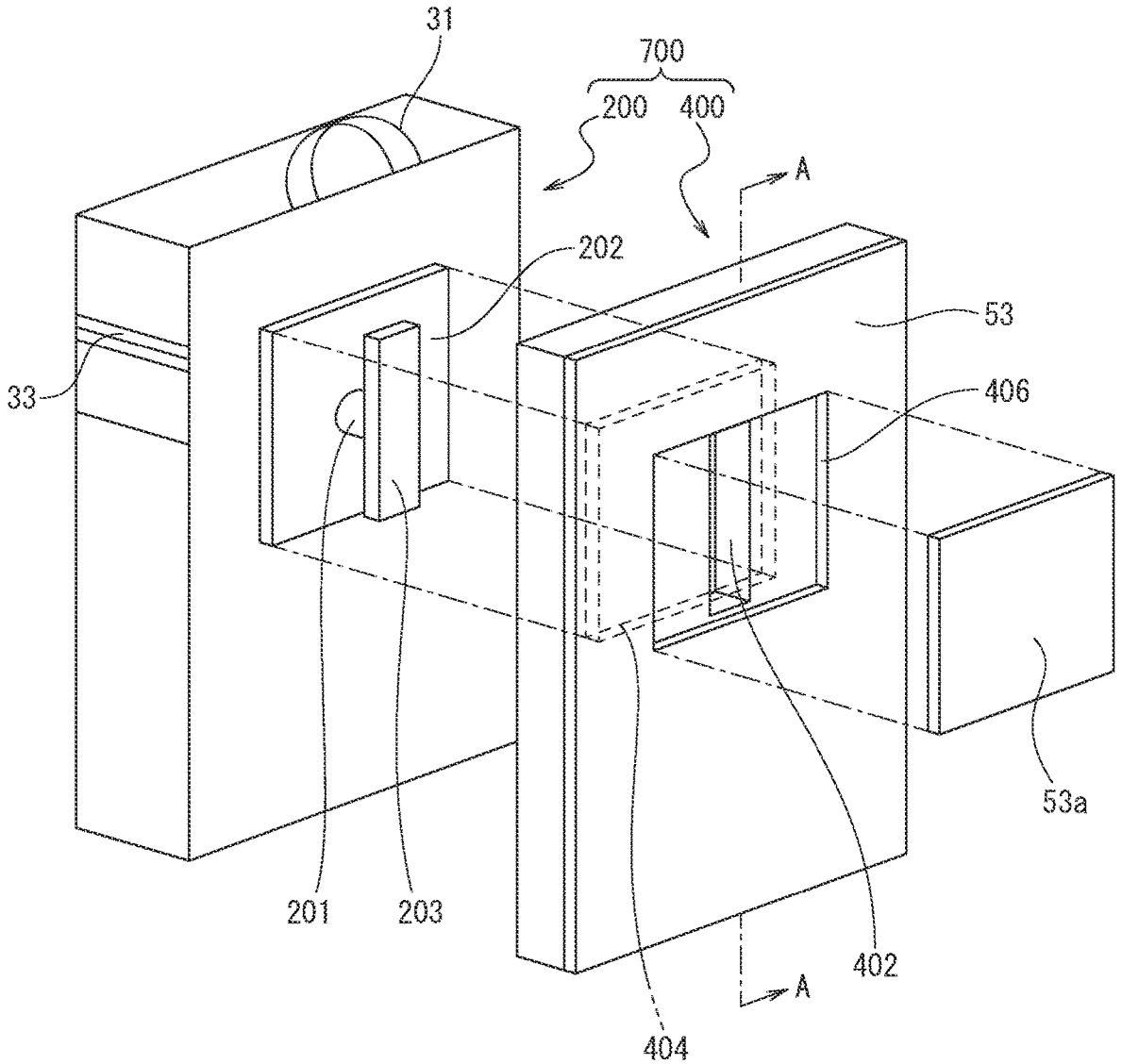
FIG. 11 is a perspective view illustrating a backpack according to a fourth modification of the first embodiment in a state of separating a storage-compartment from a back plate.
Figure 12:
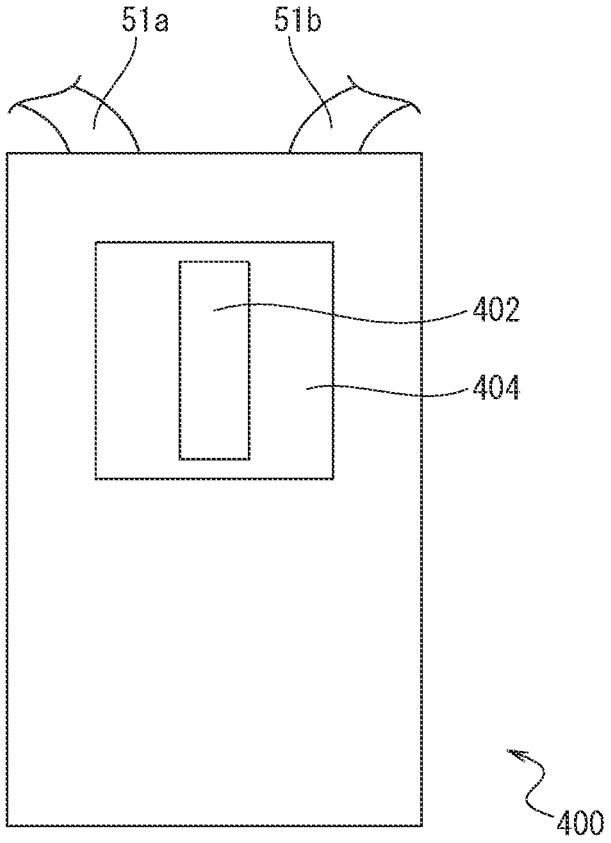
FIG. 12 is a diagram illustrating the back plate according to the fourth modification, viewed from a joint plane side.
Figure 13:
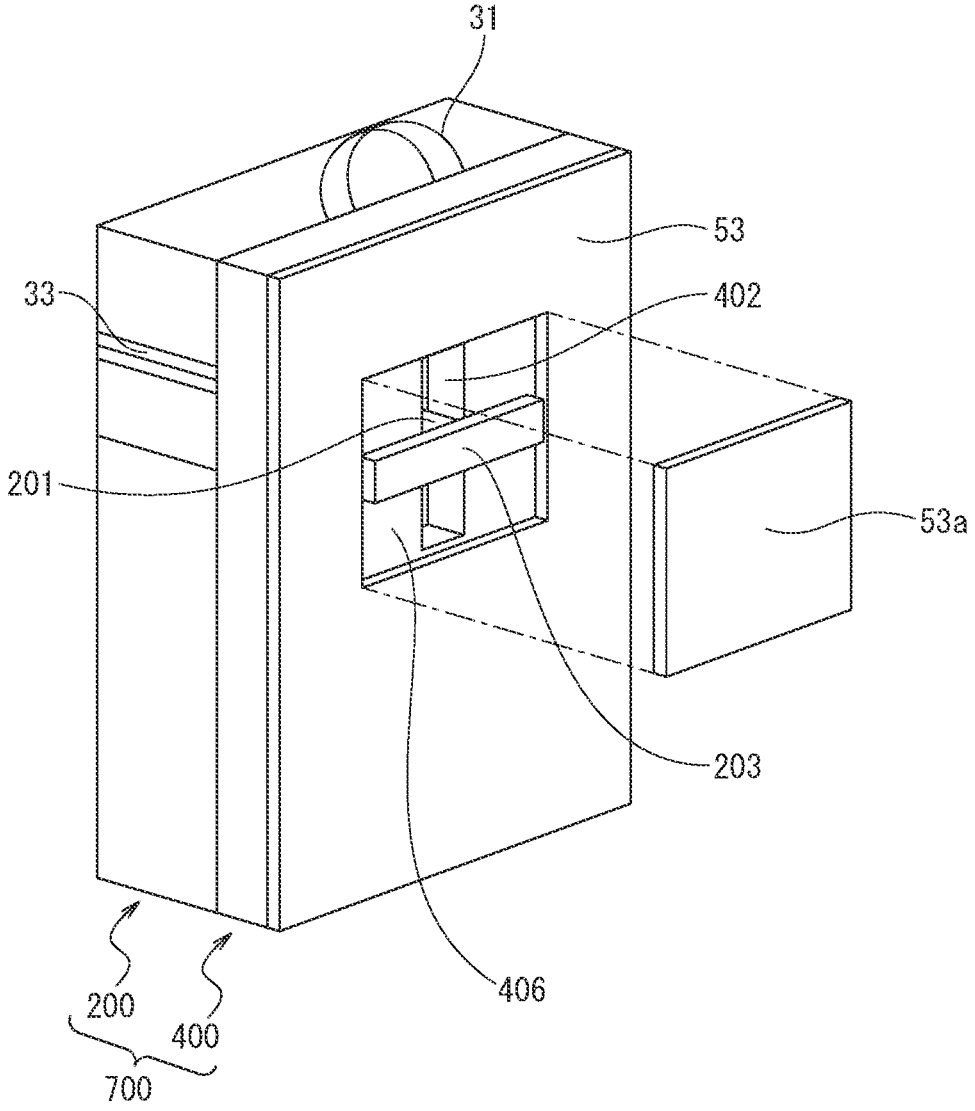
FIG. 13 is a perspective view illustrating the backpack according to the fourth modification.
Figure 19:
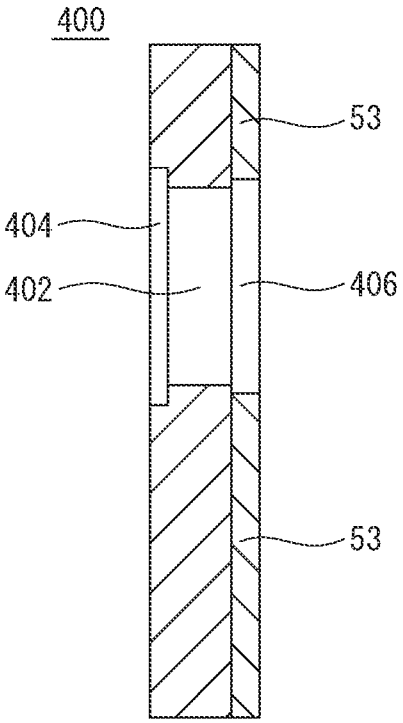
FIG. 19 is a cross sectional view of the back plate according to the fourth modification, taken on line A-A of FIG. 11.

As illustrated in FIG. 11, a backpack 700 according to a fourth modification of the first embodiment encompasses a box-shaped storage-compartment 200 and a back plate 400 removable from the storage-compartment 200. The storage-compartment 200 has a box-shaped structure implemented by first and second main surfaces opposite to each other, and triple side-surfaces. The triple side-surfaces connects triple continuous sides defined to the first main surface and the counterpart triple continuous sides assigned to the second main surface opposite to the triple continuous sides of the first main surface. The back plate 400 has a plate-shape structure, and has a joint plane opposite to the first main surface when combining to the storage-compartment 200 and a backrest plane opposite to the joint plane. The back plate 400 has a pair of shoulder straps (51*a*, 51*b*) bridging from an upper portion of the backrest plane to a lower portion of the backrest plane. In FIG. 11, FIG. 13 and FIG. 19, the pair of shoulder straps (51*a*, 51*b*) is omitted for simplifying the drawings. In the backpack 700 according to the fourth modification, a convex element (201, 203) is provided on the first main surface, and an insertion hole 402 having a structure corresponding to the convex element (201, 203) is provided in the location corresponding to the convex element (201, 203) on the joint plane. Also, the attachment and the detachment of the storage-compartment 200 and the back plate 400 is freely achieved, by passing the convex element (201, 203) through the insertion hole 402 and by pulling the convex element (201, 203) out from the insertion hole 402. Furthermore, the backpack 700 according to the fourth modification encompasses a backrest-cushion pad-cover 53*a* for covering the convex element (201, 203) when the convex element (201, 203) is inserted to the insertion hole 402.

In the backpack 700 according to the fourth modification, a structure of the convex element (201, 203), a structure of the insertion hole 402 and corresponding fixing scheme of the storage-compartment 200 and the back plate 400 ascribable to the structures of the convex element (201, 203) and the insertion hole 402 are different from the backpack 1 of the first embodiment. Also, the backpack 700 according to the fourth modification is different from the backpack 1 explained in the first embodiment, regarding the point that the backpack 700 encompasses the backrest-cushion pad-cover 53*a* for covering the convex element (201, 203) when the convex element (201, 203) is inserted to the insertion hole 402 from the backrest plane side. The other members and schemes of connecting the elements of the backpack 700 according to the fourth modification, usages of that backpack 700, etc., other than the differences above, are similar to the backpack 1 recited in the first embodiment.

In the backpack 700 according to the fourth modification, as illustrated in FIG. 11, FIG. 13, etc., the backpack 700 has a fixing mechanism that the storage-compartment 200 is fixed to the back plate 400 by passing the convex element (201, 203) through the insertion hole 402, and by using a fixing handle 203 of the tip portion of the convex element (201, 203). In the backpack 700 according to the fourth modification, the storage-compartment 200 and the back plate 400 are separated each other, when the fixing by the fixing handle 203 as the fixing mechanism is released, and the convex element (201, 203) is put out from the insertion hole 402. The storage-compartment 200 encompasses a fastener 33 and a top handle 31 at the upper portion of the storage-compartment 200, a pedestal 202 on the first main surface, the convex element (201, 203) on the pedestal 202, and the fixing handle 203 at the tip portion of the convex element (201, 203).

Figure 18:
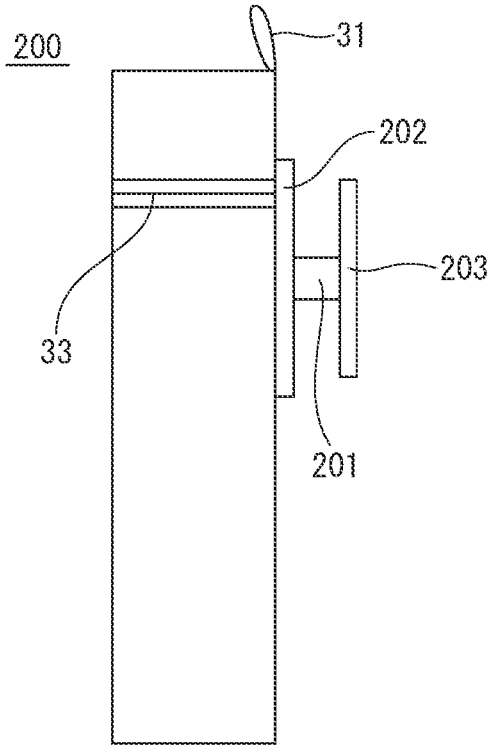
FIG. 18 is a right-side diagram illustrating the storage-compartment according to the fourth modification.

As illustrated in FIG. 11 and FIG. 18, the fixing handle 203 which is located at the tip portion of the convex element (201, 203) is a freely rotatable element in a rotation surface in parallel with the first main surface provided the convex element (201, 203), around a handle axis 201 as the center of rotation. In order to combine the storage-compartment 200 with the back plate 400, for example, as illustrated in FIG. 13, after passing the fixing handle 203 through the insertion hole 402, the fixing handle 203 is rotated about 90 degrees in one direction among the left and right directions around the handle axis 201 as the center of rotation in the rotation surface in parallel with the first main surface, and the storage-compartment 200 is fixed to the back plate 400. In the rotation angle of the fixing handle 203, any angle except zero degree and 180 degrees is good for fixing the storage-compartment 200 with the back plate 400. As used herein, "zero degree" of the rotation angle of the fixing handle 203 is defined by a state that the fixing handle 203 does not rotate after passing the fixing handle 203 through the vertically long insertion hole 402. In the state of zero degree, the fixing handle 203 is freely put out from the insertion hole 402. The rotation angle when the fixing handle 203 is rotated is determined by using "zero degree" as the reference. It is preferable that the rotation angle of the fixing handle 203 is from 45 degrees to 135 degrees, from the point of the stability of fixing. As illustrated in FIG. 13, the fixing handle 203 and the peripheral area of the fixing handle 203 is covered by the backrest-cushion pad-cover 53*a*, after fixing the storage-compartment 200 with the back plate 400, so as not to make the user feel uncomfortable on own back when the user carries the backpack 700. As a method of attaching the backrest-cushion pad-cover 53*a* to the back plate 400, for example, a method of opening the small holes for putting the screws through at the four corners of the backrest-cushion pad-cover 53*a*, and fixing the storage-compartment 200 with the backrest plane of the back plate 400 by the screws putted through the small holes, is applicable. Also, as another fixing methods, using a surface fastener, using a magnetic force, etc., are applicable to the fourth modification.

In the backpack 700 according to the fourth modification, since the backpack 700 has no fixing lid, the operation of closing the cover when the storage-compartment 200 is fixed to the back plate 400, can be omitted. In the backpack 700 according to the fourth modification, it is possible to fix the storage-compartment 200 with the back plate 400 by only rotating the fixing handle 203, even if the backpack 700 does not encompasses a fixing lid. Also, the backpack 700 according to the fourth modification can provide the advantageous effect as below. That is, the operation of attachment and detachment when exchanging the storage-compartment 200 or the back plate 400 of the backpack 700 becomes easier, compared with the first embodiment, the first to third modifications of the first embodiment. In the backpack 700 according to the fourth modification, since the fixing handle 203 is fixed to the handle axis 201, there is no anxiety of losing the fixing handle 203 as the fixing mechanism.

It is preferable that the backrest plane has a shape close to a plane, in order to keep the user feel comfortable in the state of attaching the backrest-cushion pad-cover 53*a* to the backrest cushion pad 53. That is, as illustrated in FIG. 11, etc., it is preferable that the backpack 700 encompasses a shallower concave portion 406 on the backrest cushion pad 53 for storing the backrest-cushion pad-cover 53*a*, in advance. It is preferable that the backrest-cushion pad-cover 53*a* is made of the same material of the backrest cushion pad 53, but the backrest-cushion pad-cover 53*a* does not have to be made of a material as same as the material of the backrest cushion pad 53.

According to the backpack 700 pertaining to the fourth modification, similar to the backpack 1 explained in the first embodiment, the storage-compartment 200 or the back plate 400 can be exchanged to the arbitrary storage-compartment or the arbitrary back plate among the plurality of options of storage-compartments or the plurality of options of back plates, by separating the storage-compartment 200 from the back plate 400 or by combining the storage-compartment 200 with the back plate 400, if the plurality of options of storage-compartments and the plurality of options of back plates are prepared. Also, another person or anyone else just happen to be the place can exchange the storage-compartment 200 to the other storage-compartment, while the user is carrying the backpack 700 pertaining to the fourth modification, if the plurality of options of storage-compartments and the plurality of options of back plates are prepared. As a result of adoptions of the above structures, similar to the backpack 1 explained in the first embodiment, the backpack 700 pertaining to the fourth modification has variety, diverseness and multifariousness in the combination of the storage-compartment 200, the back plate 400, etc., and the degrees of freedom to select color, shape, etc., increases drastically. The variety of the combination can also bring economic advantages. The backpack 700 pertaining to the fourth modification is very economical for user, because various situations will be sometimes occurred in user, such that the user is enough to prepare, or purchase either one of a new storage-compartment or a new back plate, when any backpack having a preferred appearance is desired to be owned.

Second Embodiment

Figure 14:
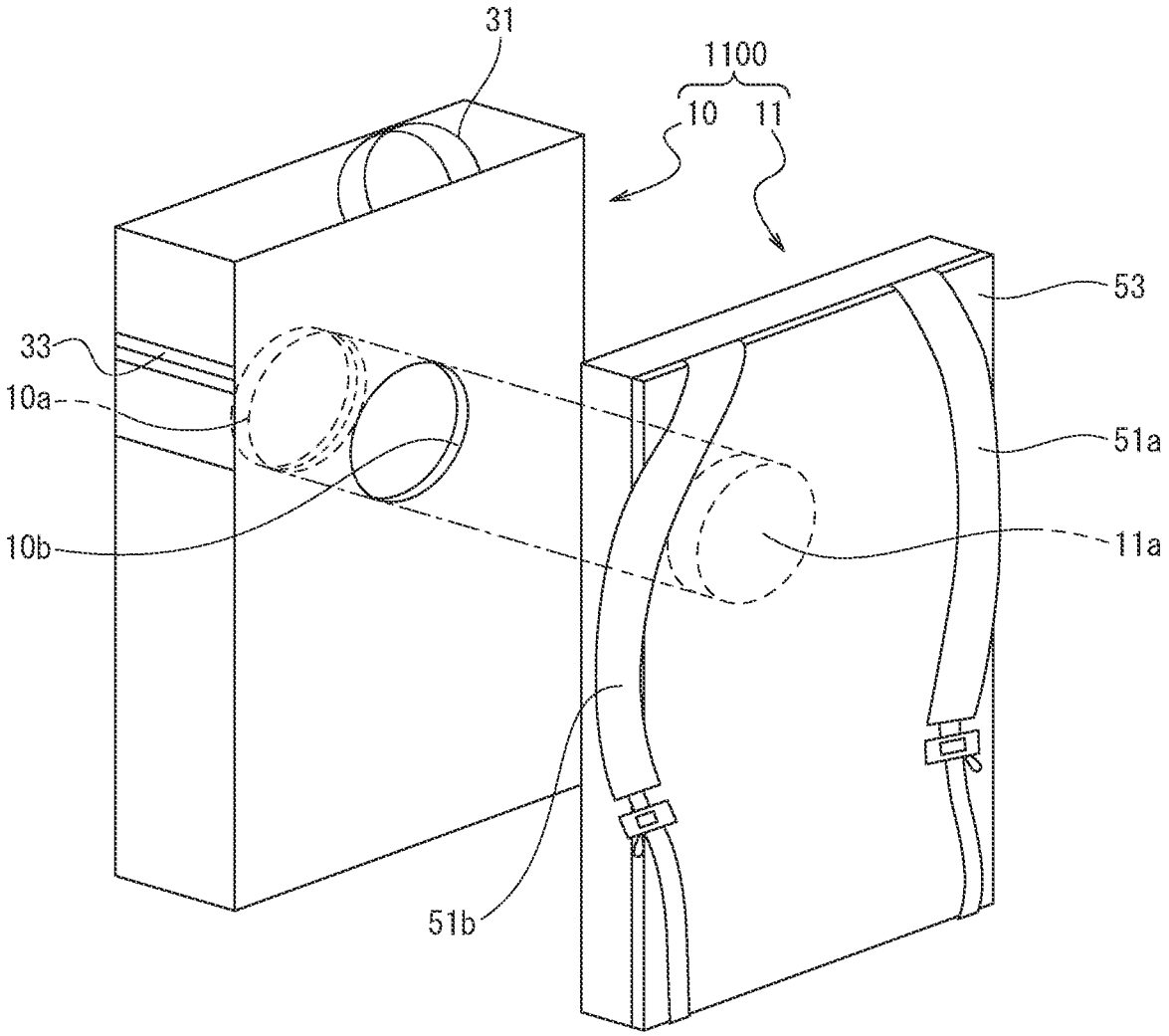
FIG. 14 is a perspective view illustrating a backpack according to a second embodiment in a state of separating a storage-compartment from a back plate.

As illustrated in FIG. 14, a backpack 1100 according to a second embodiment encompasses a box-shaped storage-compartment 10 and a back plate 11 removable from the storage-compartment 10. The storage-compartment 10 has a box-shaped structure implemented by first and second main surfaces opposite to each other, and triple side-surfaces. The triple side-surfaces connects triple continuous sides defined to the first main surface and the counterpart triple continuous sides assigned to the second main surface opposite to the triple continuous sides of the first main surface. The back plate 11 has a plate-shape structure, and has a joint plane opposite to the first main surface when combining to the storage-compartment 10 and a backrest plane opposite to the joint plane. The back plate 11 has a pair of shoulder straps (51*a*, 51*b*) bridging from an upper portion of the backrest plane to a lower portion of the backrest plane. In the backpack 1100 according to the second embodiment, a convex element 11*a* is provided on the joint plane, an insertion hole 10*b* having a structure corresponding to the convex element 11*a* is provided in the location corresponding to the convex element 11*a* on the first main surface. Also, the attachment and the detachment of the storage-compartment 10 and the back plate 11 is freely achieved, by passing the convex element 11*a* through the insertion hole 10*b* and by pulling the convex element 11*a* out from the insertion hole 10*b*.

The backpack 1100 according to the second embodiment is different from the backpack 1 explained in the first embodiment, at technical features of the locations of the convex element and the insertion hole where the convex element can be allowed to pass through. That is, since the convex element 11*a* is provided on the joint plane and the insertion hole (first insertion hole) 10*b* is provided in the first main surface, the backpack 1100 has a structure opposite to the structure of the backpack 1 explained in the first embodiment, at technical features of the locations of the convex element and the insertion hole. A fixing lid (first fixing lid) 10*a* as "the fixing mechanism (first fixing mechanism)" which fixes the convex element 11*a* to the storage-compartment 10 is provided at the tip portion of the convex element 11*a*, so as to be possible to attach to and detach from the convex element 11*a* freely. Since the fixing lid 10*a* has an external form larger than the insertion hole 10*b*, the fixing lid 10*a* cannot pass the insertion hole 10*b* through. The fixing lid 10*a* fixes the convex element 11*a* to the storage-compartment 10 from the inside of the storage-compartment 10 by combining the convex element 11*a*. For convenience of putting the goods in and out the storage-compartment 10, it is preferable that the fixing lid 10*a* is set, so as not to project too much toward the inside of the storage-compartment 10 when combining with the convex element 11*a*.

In the backpack 1100 according to the second embodiment, a rubber packing or an element instead of the rubber packing may be sandwiched between the fixing lid 10*a* and the first main surface, preventing from letting raindrops and the like enter into the storage-compartment 10. As a result, a performance of high waterproof property is achieved.

A fixing the storage-compartment 10 to the back plate 11 can be operated by the same operation as the backpack 1 explained in the first embodiment, using the elements having the same mechanism as the backpack 1 recited in the first embodiment. The other elements and methods of connecting the elements of the backpack 1100 according to the second embodiment, usages of that backpack 1100, etc., other than the differences above, such as the locations of the convex element and the insertion hole passing the convex element through, are as same as backpack 1 recited in the first embodiment.

According to the backpack 1100 pertaining to the second embodiment, similar to the backpack 1 explained in the first embodiment, the storage-compartment 10 or the back plate 11 can be exchanged to the arbitrary storage-compartment or the arbitrary back plate among the plurality of options of storage-compartments or the plurality of options of back plates, by separating the storage-compartment 10 from the back plate 11 or by combining the storage-compartment 10 with the back plate 11, if the plurality of options of storage-compartments and the plurality of options of back plates are prepared. Also, another person or anyone else just happen to be the place can exchange the storage-compartment 10 to the other storage-compartment, while the user is carrying the backpack 1100 pertaining to the second embodiment, if the plurality of options of storage-compartments and the plurality of options of back plates are prepared. As a result of adoptions of the above structures, similar to the backpack 1 explained in the first embodiment, the backpack 1100 pertaining to the second embodiment has variety, diverseness and multifariousness in the combination of the storage-compartment 10, the back plate 11, etc., and the degrees of freedom to select color, shape, etc., increases drastically. The variety of the combination can also bring economic advantages. The backpack 1100 pertaining to the second embodiment is very economical for user, because various situations will be sometimes occurred in user, such that the user is enough to prepare, or purchase either one of a new storage-compartment or a new back plate, when any backpack having a preferred appearance is desired to be owned.

Figure 15:
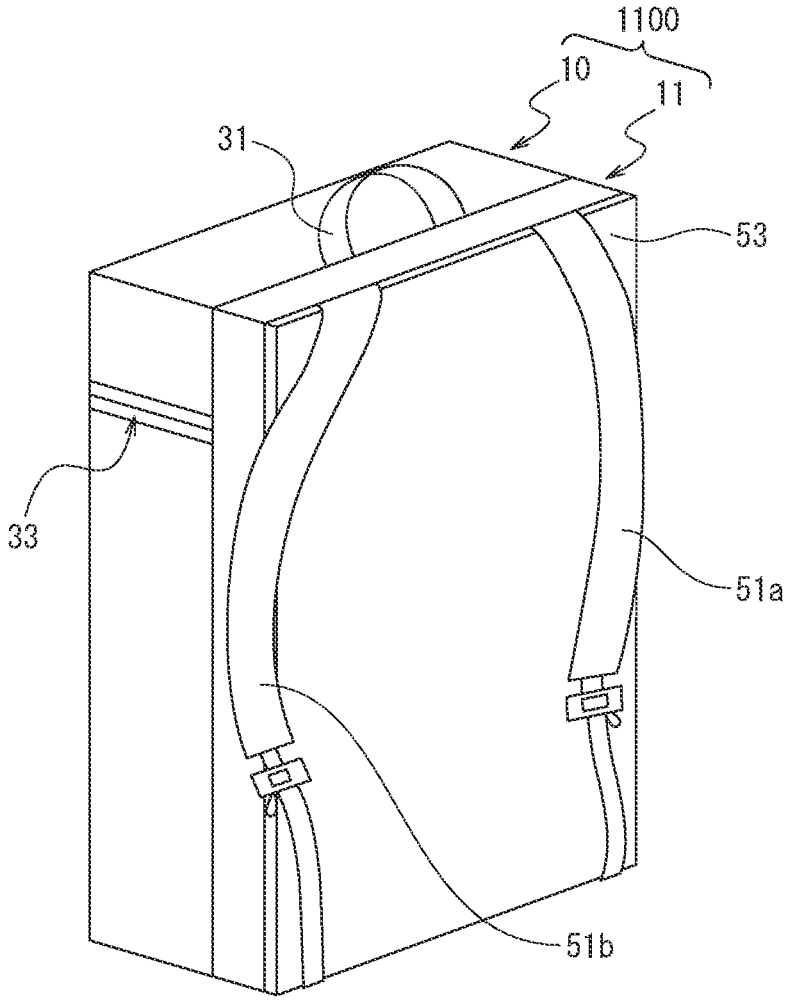
FIG. 15 is a perspective view illustrating a backpack according to the second embodiment.

According to the backpack 1100 of the second embodiment, since the fixing lid 10*a* is provided in the storage-compartment 10, another person or anyone else just happen to be the place can execute an exchange operation of the storage-compartment 10 easily in a state that the user carries the backpack 1100 on the back, compared with the backpack 1 recited in the first embodiment. Furthermore, as illustrated in FIG. 15, the comfort level of the user when the user carries the backpack 1100 can be higher, in the state of fixing the storage-compartment 10 to the back plate 11, because of no roughness caused by existence of fixing means, on backrest cushion pad 53 of the backrest plane.

Other Embodiments

As described above, the present invention is explained by the first embodiment, the first to fourth modifications of the first embodiment, and the second embodiment, but the descriptions and the drawings that implement a part of the disclosure of invention should not be construed to limit the present invention. That is, persons skilled in the art can produce various embodiments and modifications and operational techniques, based on the disclosure above.

For, example, considering the visibility from the backward view and the ensuring of user's safety from the traffic accident, etc., a LED illumination panel, etc., may be provided on entire surface, some parts or one part of the storage-compartment 3, in the backpack 1 recited in the first embodiment. As a result, the user's safety in the night and day can be drastically improved. Therefore, the backpack according to the present invention is effective when using the backpack as a backpack, a school backpack, etc., for a child and an elementary school student.

Also, for example, the cross-sectional view of the convex element 6 of the backpack 1 explained in the first embodiment is a perfect circle and the entire form of the convex element 6 is a columnar form, in FIG. 1. However, the cross-sectional view of the convex element 6 may be an elliptical form and the entire form of the convex element 6 may be a cylindrical form. Furthermore, the form of the convex element 6 may be the other forms except the forms above. In the case that the cross-sectional view of the convex element 6 is not the perfect circle and the entire form of the convex element 6 is not the columnar form, it is possible to prevent the rotary motion of the storage-compartment 3 against the back plate 5, by only passing the convex element 6 through the insertion hole 54. In the case that the cross-sectional view of the convex element 6 is not the perfect circle and the entire form of the convex element 6 is not the columnar form, the pedestal 32 and the pedestal-storing depression 55 as illustrated in FIG. 1, etc., for preventing the rotary motion, is not necessary.

As a further operational technique, the backpack 1 pertaining to the first embodiment etc. can be used as a specific backpack which contains a blower apparatus for circulating air into a protective clothing for a medical worker, etc. For housing the blower apparatus in the protective clothing, the back plate 5 of the backpack 1 pertaining to the first embodiment may further includes a first air duct which passes through from the joint plane to the backrest plane, in order to connect the first air duct to the corresponding hole (air intake) of the protective clothing. Also, the storage-compartment 3 connected to the back plate 5 may include a battery (Lithium-ion battery, etc.) for operating the blower apparatus, a blower fan which let the air enter to the inside of the protective clothing, and a second air duct as the passage of the air to the back plate 5. The first air duct and the second air duct are connected each other. The insertion hole 54 of the back plate 5 may be used also for the first air duct, or the first air duct may be prepared independently from the insertion hole 54. In the case of providing the first air duct by using the insertion hole 54, the fixing means with the hole instead of the fixing lid 52 may be used, and the air may be entered into the protective clothing. In addition, in the case of providing the first air duct by using the insertion hole 54, the convex element 6 of the storage-compartment 3 may be used also for the second air duct. In this case, the convex element 6 has a hole, this hole passes through the pedestal 32 and the first main surface of the storage-compartment 3, and this hole is connected to at least the inside of the storage-compartment 3. The blower fan may be provided at the inside of the storage-compartment 3, or may be provided on the second main surface side or the other side surfaces. In the case that the insertion hole 54 of the back plate 5 is not used also for the first air duct, the second air duct is provided at a location corresponding to the first air duct. The filter having a function which blocks the intrusion of virus is provided at a portion where the air is sucked from the outside of the backpack 1 into the storage-compartment 3. In the protective clothing, it supposes that the air intake with the filter which combines with the first air duct and circulates the air into the protective clothing, is provided at the back surface side, and that the air outlet with the filter which releases the air from the inside of the protective clothing to the outside of the protective clothing, is provided at the back side of head, etc. In the case of the protective clothing not covering the user's head portion, for example, the air outlet may be provided at around the back of knee, around the feet, etc. Also, the number and the location of the air outlets are not limited. In the case that the diameter or the area of the air outlet is larger than that of the air intake, it is possible to easily release the air from the inside of the protective clothing. Furthermore, it is preferable that valves, such as check valves, are provided at the first and second air ducts, and the air intake and the air outlet of the protective clothing, respectively, for preventing the backward flow of the air.

When using backpack 1 which incorporates the blower apparatus, at first, the user as the medical worker who uses the backpack 1 carries the back plate 5 on the back, and connects the first air duct of the back plate 5 to the intake of the protective clothing, after wearing the protective clothing in a place without a fear of viral infection, such as a clean room. Next, the user connects the storage-compartment 3 to the back plate 5. And the backpack 1 has a mechanism that the air is taken into the inside of the protective clothing, when turning the blower apparatus on and activating the blower fan. In of the protective clothing, the air taken in the protective clothing is diffused, and the air in the protective clothing is released from the inside of the protective clothing to the outside of the protective clothing through the air outlet of the protective clothing. In the case that the user desires to use the protecting clothing without the blower apparatus, the backpack 1 is released from the weight of the blower apparatus by detaching the storage-compartment 3 from the back plate 5. In the case that the user desires to use the protecting clothing without the blower apparatus, and the valves, such as check valves, is provided at the first air duct of the back plate 5, the user may operate while the user carries the back plate 5 on the back. Also, the back plate 5 should be a dedicated element for the specific user through the lifetime of the backpack 1, from the point of view of preventing the infection expansion of virus, etc. Furthermore, the same as above, from the point of view of preventing the infection expansion of virus, etc., it is preferable that the user operates while carrying the back plate 5, when the user uses the protective clothing without using the blower apparatus. The advantage that the attachment of the storage-compartment 3 with the blower fan is completed quickly, is obtained by operating while carrying the back plate 5 on the back, in the situation of using the blower apparatus again. As illustrated in FIG. 1, etc., since the back plate 5 itself is thin and relatively light, the disturbance regarding the operation of user is almost not generated.

It is possible to reduce the rise of temperature and humidity of the inside of the protective clothing which is connected to the backpack 1, and to keep the comfort of using the protective clothing while the intrusion of virus, etc., to the user is prevented. In particular, the backpack 1 which installs the blower apparatus is effective, in the case of using the protective clothing in the indoor or outdoor of summer season. In the backpack 1 which installs the blower apparatus, it is possible to use the back plate 5 most close to the user and having the largest contact numbers to the user, as the dedicated element for the specific user. As a result, the possibility of the infection expansion of virus to the other persons is considerably reduced, especially. In the backpack 1 which installs the blower apparatus, the backpack 1 has an advantage that the sending the air to the inside of the protective clothing can restart quickly while the infection expansion of virus to the other persons is prevented, after only exchanging the storage-compartment 3 with the blower apparatus for exchanging the filter, etc., of the blower fan side. In the backpack 1 which installs the blower apparatus, the storage-compartment 3 can be also used as the goods-storage element, and, for example, it is possible to store a decontamination and disinfection article, a spare filter, etc. Of course, the blower apparatus is applicable not only to the backpack 1 pertaining to the first embodiment, but also to the backpack pertaining to the other embodiments and the other modifications.

Furthermore, it is also possible to combine the technical ideas explained with the first embodiment, the first to fourth modifications of the first embodiment, and the second embodiment, etc., mutually. For example, in the second embodiment, although the storage-compartment 10 and the back plate 11 is combined by the one convex element and the one insertion hole, the number of the convex elements and the insertion holes may be a plural number as illustrated in the first to fourth modifications of the first embodiment. In the backpack 1100 pertaining to the second embodiment, the fixing and supporting force between the storage-compartment 10 and the back plate 11 becomes stronger by encompassing the combination portions at the four corners of the storage-compartment 10 and the back plate 11. As described above, naturally, the present invention includes various embodiments and modifications and the like which are not detailed above. Therefore, the technical scope of the present invention will be defined by only the invention specific matter according to the following claims which is drew from the above-mentioned description appropriately.

What is claimed is:

1. A backpack comprising:

a box-shaped storage-compartment having first and second main surfaces having rectangular shapes, respectively, the first and second main surfaces being opposite to each other, and triple side-surfaces mutually connecting triple continuous sides of the first main surface with counterpart triple sides of the second main surface; and a back plate with no internal storage space configured to be removable from the storage-compartment, having a joint plane opposite to the first main surface when combining the back plate with the storage-compartment, a backrest plane opposite to the joint plane, and a pair of shoulder straps bridging from an upper portion of the backrest plane to double sites located a lower portion of the backrest plane;

a convex element provided on either one of the first main surface or the joint plane; and a penetrating insertion hole having an inner structure mating to an outer structure of the convex element and a location being aligned to a position of the convex element, the penetrating insertion hole penetrates completely through the first main surface into a space surrounded by the first and second main surfaces and triple side-surfaces of the storage-compartment and the penetrating insertion hole being accessible from an interior of the storage-compartment, or the penetrating insertion hole penetrates completely through the back plate into an outer open space so that the penetrating insertion hole provides a canal connecting between the joint plane side and the backrest plane side, wherein the storage-compartment can be freely attached and fixed to the back plate only by a fixing structure implemented by inserting the convex element in the penetrating insertion hole and the convex element inserted in the penetrating insertion hole, which are allocated at a position between the upper portion and the lower portion, and the storage-compartment can be freely detached from the back plate by extracting the convex element from the penetrating insertion hole.

2. The backpack of claim 1, further comprising:

a fixing mechanism provided at an end piece of the convex element, wherein the fixing of the storage-compartment to the back plate is conducted by the fixing mechanism in a state of passing the convex element through the penetrating insertion hole, and a detaching of the convex element from the penetrating insertion hole is conducted by releasing the fixing mechanism.

3. The backpack of claim 2, wherein the fixing mechanism has a size impossible to pass through the penetrating insertion hole.

4. The backpack of claim 2, wherein the fixing mechanism has a size and a shape facilitating a movement of the fixing mechanism in the penetrating insertion hole, configured to rotate in a rotation surface in parallel with the first main surface for establishing a configuration to fix the storage-compartment to the back plate.

5. The backpack of claim 1, further comprising:

a pedestal disposed on either one of the first main surface or the joint plane, configured to mount and fix the convex element on the pedestal;

a pedestal-storing depression having a shape and a size for storing the pedestal, being cut in other one of the first main surface or the joint plane, configured to be continued to the penetrating insertion hole, wherein a rotation of the storage-compartment against the back plate is inhibited by a geometry implemented by the pedestal-storing depression and the pedestal inserted in the pedestal-storing depression.

6. The backpack of claim 1, further comprising:

a second convex element provided parallel with the convex element on either one of the first main surface or the joint plane; and a second penetrating insertion hole cut parallel with the penetrating insertion hole in other one of the first main surface or the joint plane, having a structure and a location corresponding to the second convex element.

7. The backpack of claim 1, further comprising a fixing lid that is operable to couple the convex element to the back plate.

8. A set of backpacks comprising:

a plurality of box-shaped storage-compartments, each of storage-compartments having first and second main surfaces having rectangular shapes, respectively, the first and second main surfaces being opposite to each other, and triple side-surfaces mutually connecting triple continuous sides of the first main surface with counterpart triple sides of the second main surface; and a back plate with no internal storage space having a joint plane opposite to the first main surface when combining the back plate with the storage-compartment, a backrest plane opposite to the joint plane, and a pair of shoulder straps bridging from an upper portion of the backrest plane to double sites located a lower portion of the backrest plane;

a set of convex elements provided on each of the first main surfaces of the plurality of storage-compartments or a convex element provided on the joint plane; and a penetrating insertion hole having an inner structure mating to an outer structure of the convex element and a location being aligned to a position of the convex element, the penetrating insertion hole penetrates completely through the first main surface into a space surrounded by the first and second main surfaces and triple side-surfaces of the storage-compartment and the penetrating insertion hole being accessible from an interior of the storage-compartment, or the penetrating insertion hole penetrates completely through the back plate into an outer open space so that the penetrating insertion hole provides a canal connecting between the joint plane side and the backrest plane side, wherein a combination of one of storage-compartments and the back plate can be optionally selected, and a selected storage-compartment can be freely attached and fixed to the back plate only by a fixing structure implemented by inserting the convex element in the penetrating insertion hole and the convex element inserted in the penetrating insertion hole, which are allocated at a position between the upper portion and the lower portion, and the storage-compartment can be freely detached from the back plate by extracting the convex element from the penetrating insertion hole.

9. The set of backpacks of claim 8, wherein each of the storage-compartments or the back plate further comprises:

a fixing mechanism provided at an end piece of the convex element, wherein the fixing of the selected storage-compartment to the back plate is conducted by the fixing mechanism in a state of passing the convex element through the penetrating insertion hole, and a detaching of the selected convex element from the penetrating insertion hole is conducted by releasing the fixing mechanism.

10. The set of backpacks of claim 8, further comprising a fixing lid that is operable to couple each convex element to the corresponding back plate.

11. A set of backpacks comprising:

a plurality of box-shaped storage-compartments, each of storage-compartments having first and second main surfaces having rectangular shapes, respectively, the first and second main surfaces being opposite to each other, and triple side-surfaces mutually connecting triple continuous sides of the first main surface with counterpart triple sides of the second main surface; and a plurality of back plates with no internal storage space, each of back plates having a joint plane opposite to the first main surface when combining the back plate with the storage-compartment, a backrest plane opposite to the joint plane, and a pair of shoulder straps bridging from an upper portion of the backrest plane to double sites located a lower portion of the backrest plane;

a set of convex elements provided on each of the first main surfaces of the plurality of storage-compartments or on each of the joint planes; and a set of penetrating insertion holes each having an inner structure mating to an outer structure of the convex element and a location being aligned to a position of the convex elements, each of the penetrating insertion holes penetrates completely through the first main surface into a space surrounded by the first and second main surfaces and triple side-surfaces of corresponding storage-compartments and the penetrating insertion hole being accessible from an interior of the storage-compartment, or each of the penetrating insertion hole penetrates completely through the corresponding back plate into an outer open space so that the penetrating insertion hole provides a canal connecting between the joint plane side and the backrest plane side, wherein a combination of one of storage-compartments and one of the back plates can be optionally selected, and a selected storage-compartment can be freely attached and fixed to a selected back plate only by a corresponding fixing structure implemented by inserting the convex element in the penetrating insertion hole and the convex element inserted in the penetrating insertion hole, which are allocated at a position between the upper portion and the lower portion of the selected back plate, and the selected storage-compartment can be freely detached from the selected back plate by extracting the convex element from the penetrating insertion hole.

12. The set of backpacks of claim 11, wherein each of the storage-compartments or each of the back plates further comprises:

a fixing mechanism provided at an end piece of the convex element, wherein the fixing of the selected storage-compartment to the selected back plate is conducted by the fixing mechanism in a state of passing the convex element through the penetrating insertion hole, and a detaching of the selected convex element from the penetrating insertion hole is conducted by releasing the fixing mechanism.

13. The set of backpacks of claim 11, further comprising a fixing lid that is operable to couple each convex element to the corresponding back plate.

* * * * *